US007219747B2

(12) United States Patent
Gleitman et al.

(10) Patent No.: US 7,219,747 B2
(45) Date of Patent: May 22, 2007

(54) PROVIDING A LOCAL RESPONSE TO A LOCAL CONDITION IN AN OIL WELL

(75) Inventors: Daniel D. Gleitman, Houston, TX (US); Paul F. Rodney, Spring, TX (US); James H. Dudley, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 384 days.

(21) Appl. No.: 10/793,062

(22) Filed: Mar. 4, 2004

(65) Prior Publication Data

US 2005/0194183 A1 Sep. 8, 2005

(51) Int. Cl.
*E21B 44/00* (2006.01)
*E21B 47/00* (2006.01)
*G06F 19/00* (2006.01)

(52) U.S. Cl. ..... 175/40; 175/45; 702/9

(58) Field of Classification Search ..... 175/40, 175/45; 703/10; 702/9
See application file for complete search history.

(56) References Cited

U.S. PATENT DOCUMENTS

| | | | | |
|---|---|---|---|---|
| 3,223,184 A | | 12/1965 | Jones et al. | 175/41 |
| 4,273,212 A | | 6/1981 | Dorr et al. | 181/102 |
| 4,379,493 A | | 4/1983 | Thibodeaux | 175/61 |
| 4,384,483 A | | 5/1983 | Dellinger et al. | 73/151 |
| 4,535,429 A | | 8/1985 | Russell et al. | 367/85 |
| 4,553,428 A | | 11/1985 | Upchurch | 73/152 |
| 4,697,650 A | | 10/1987 | Fontenot | 175/50 |
| 4,779,852 A | | 10/1988 | Wassell | 267/125 |
| 4,791,797 A | | 12/1988 | Paske et al. | 73/152 |
| 4,805,449 A | | 2/1989 | Das | 73/151 |
| 4,995,267 A | * | 2/1991 | Mikheev et al. | 73/8 |
| 5,156,223 A | | 10/1992 | Hipp | 175/296 |
| 5,563,512 A | | 10/1996 | Mumby | 324/339 |
| 5,679,894 A | | 10/1997 | Kruger et al. | 73/152.03 |
| 5,798,488 A | | 8/1998 | Beresford et al. | 181/102 |
| 5,804,713 A | | 9/1998 | Kluth | 73/152.01 |
| 5,842,149 A | | 11/1998 | Harrell et al. | 702/9 |
| 5,886,303 A | | 3/1999 | Rodney | 181/102 |
| 5,995,020 A | | 11/1999 | Owens et al. | 340/854.9 |

(Continued)

FOREIGN PATENT DOCUMENTS

GB 2235540 A 3/1991

OTHER PUBLICATIONS

E Alan Coats, Marty Paulk, Chris Dalton, "Wired Composite Tubing Reduces Drilling Risk," Drilling Contractor, pp. 22-23, Jul./Aug. 2002.

(Continued)

*Primary Examiner*—William Neuder
(74) *Attorney, Agent, or Firm*—Baker Botts L.L.P.

(57) ABSTRACT

A method and apparatus for providing a local response to a local condition in an oil well are disclosed. A sensor is provided to detect a local condition in a drill string. A controllable element is provided to modulate energy in the drill string. A controller is coupled to the sensor and to the controllable element. The controller receives a signal from the sensor, the signal indicating the presence of said local condition, processes the signal to determine a local energy modulation in the drill string to modify said local condition, and sends a signal to the controllable element to cause the determined local energy modulation.

85 Claims, 16 Drawing Sheets

U.S. PATENT DOCUMENTS

| | | | | |
|---|---|---|---|---|
| 6,026,914 | A | 2/2000 | Adams et al. | 175/45 |
| 6,079,505 | A | 6/2000 | Pignard et al. | 175/40 |
| 6,206,108 | B1 | 3/2001 | MacDonald et al. | 175/24 |
| 6,279,392 | B1 | 8/2001 | Shahin, Jr. et al. | 73/152.52 |
| 6,325,123 | B1 | 12/2001 | Gao et al. | 152/416 |
| 6,464,021 | B1 | 10/2002 | Edwards | 175/61 |
| 6,516,880 | B1 | 2/2003 | Otten et al. | 166/250.11 |
| 6,516,898 | B1 | 2/2003 | Krueger | 175/50 |
| 6,568,486 | B1 | 5/2003 | George | 175/45 |
| 6,581,455 | B1 | 6/2003 | Berger et al. | 73/152.52 |
| 6,691,802 | B2 | 2/2004 | Schultz et al. | 175/56 |
| 2001/0054514 | A1 | 12/2001 | Sullivan et al. | 175/40 |
| 2002/0017386 | A1 | 2/2002 | Ringgenberg et al. | 166/250.17 |
| 2002/0074165 | A1 | 6/2002 | Lee et al. | 175/48 |
| 2001/0144842 | | 10/2002 | Schultz et al. | 175/39 |
| 2003/0209365 | A1 | 11/2003 | Downton | 175/50 |
| 2005/0024231 | A1 | 2/2005 | Fincher | |
| 2005/0194182 | A1* | 9/2005 | Rodney et al. | 175/24 |

OTHER PUBLICATIONS

"IntelliPipe™ Technology: Wired for Speed and Durability," U.S. Department of Energy Office of Fossil Energy http;//fossil.energy.gov/news/techlines/03/tl_intellipipe_rmotctest.html, Jun. 5, 2003.

Michael J. Jellison and David R. Hall, "Intelligent Drill Pipe Creates the Drilling Network," SPE International, SPE 80454, pp. 1-8, presented at the SPE Asia Pacific Oil and Gas Conference and Exhibition, Jakarta, Indonesia, Apr. 15-17, 2003.

A. Judzis, T. S. Green, G. M. Hoversten, and A. D. Black, "Seismic While Drilling for Enhanced Look-Ahead-of-Bit Capabilities—Case Study of Successful Mud Pulse Coupling Demonstration," Society of Professional Engineers, SPE 63194, pp. 1-4, presented at the 2000 SPE Annual Technical Conference and Exhibition held in Dallas, Texas, Oct. 1-4, 2000.

Daniel C. Minette, Eric Molz, "Utilizing Acoustic Standoff Measurements to Improve the Accuracy of Density and Neutron Measurements," Society of Petroleum Engineers Inc., SPE 56447, pp. 1-14, presented at the 1999 SPE Annual Technical Conference and Exhibition held in Houston, Texas, Oct. 3-6, 1999.

U.S. Appl. No. 60/491,567, filed Jul. 31, 2003, Roger Fincher.

U.S. Appl. No. 60/478,237, filed Jun. 13, 2003, Roger Fincher.

U.S. Appl. No. 10/793,350, filed Mar. 4, 2004, Rodney et al.

U.S. Appl. No. 10/792,541, filed Mar. 3, 2004, Rodney et al.

U.S. Appl. No. 10/793,537, filed Mar. 4, 2004, Dudley et al.

U.S. Appl. No. 11/072,795, filed Mar. 4, 2005, Daniel Gleitman.

U.S. Appl. No. 11/051,762, filed Feb. 4, 2005, Daniel Gleitman.

U.S. Appl. No. 11/070,625, filed Mar. 2, 2005, Daniel Gleitman.

"Telemetry Drill Pipe: Enabling Technology for the Downhole Internet," http://www.intellipipe.com/brochures.asp, Intellipipe Brochure 1.

"Telemetry Drill Pipe: Enabling Technology for the Downhole Internet," http://www.intellipipe.com/brochures.asp, Intellipipe Brochure 2.

International Search Report (PCT/US05/07726), Oct. 20, 2005.

* cited by examiner

| CYLINDER INPUTS: | TO 1 | TO 2 | RECIRC. | ALL CLOSED (REFILLING STORAGE) |
|---|---|---|---|---|
| CYLINDER EXHAUSTS: | VENT 2 | VENT 1 | VENT 1&2 | VENT 1&2 |

PROVIDING A LOCAL RESPONSE TO A LOCAL CONDITION IN AN OIL WELL

BACKGROUND

Wired pipe for use in drilling oil wells has become available. The use of data delivered through the wired pipe raises new challenges.

DETAILED DESCRIPTION

Figure 1:
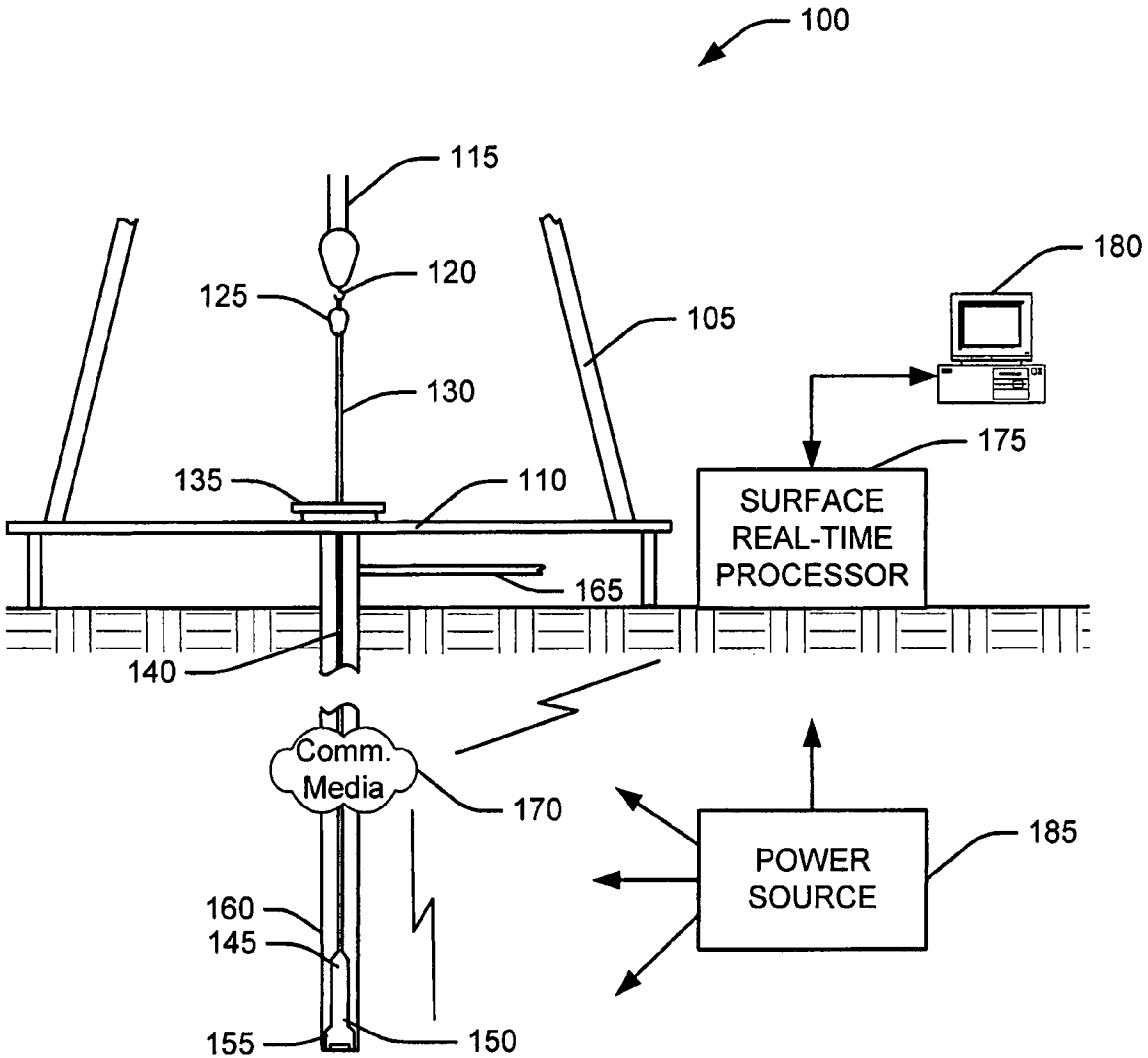
FIG. 1 shows a system for surface real-time processing of downhole data.

As shown in FIG. 1, oil well drilling equipment 100 (simplified for ease of understanding) includes a derrick 105, derrick floor 110, draw works 115 (schematically represented by the drilling line and the traveling block), hook 120, swivel 125, kelly joint 130, rotary table 135, drill string 140, drill collar 145, LWD tool or tools 150, and drill bit 155. Mud is injected into the swivel by a mud supply line (not shown). The mud travels through the kelly joint 130, drill string 140, drill collars 145, and LWD tool(s) 150, and exits through jets or nozzles in the drill bit 155. The mud then flows up the annulus between the drill string and the wall of the borehole 160. A mud return line 165 returns mud from the borehole 160 and circulates it to a mud pit (not shown) and back to the mud supply line (not shown). The combination of the drill collar 145, LWD tool(s) 150, and drill bit 155 is known as the bottomhole assembly (or "BHA"). A communications media 170 may provide communications among components in the borehole or on the surface and between those components and a surface real-time processor 175. A terminal 180 may be provided to allow a user to view data retrieved from the borehole and surface components and to provide control inputs where appropriate. A power source 185 provides power to the components in the system. In one embodiment of the invention, the drill string is comprised of all the tubular elements from the earth's surface to the bit, inclusive of the BHA elements. In rotary drilling the rotary table 135 may provide rotation to the drill string, or alternatively the drill string may be rotated via a top drive assembly. The term "couple" or "couples" used herein is intended to mean either an indirect or direct connection. Thus, if a first device couples to a second device, that connection may be through a direct connection, or through an indirect electrical connection via other devices and connections.

The drill string may be a "wired" drill string, in which joints of drill pipe are wired to pass power and communications signals to connected joints of drill pipe. Typically, node subs are located in the drill string which amplify signals as they pass. Such a wired drill string may be part of the communications media 170.

It will be understood that the term "oil well drilling equipment" or "oil well drilling system" is not intended to limit the use of the equipment and processes described with those terms to drilling an oil well. The terms also encompass drilling natural gas wells or hydrocarbon wells in general. Further, such wells can be used for production, monitoring, or injection in relation to the recovery of hydrocarbons or other materials from the subsurface.

A number of significant factors may detract from the rapid, cost-efficient, and safe drilling of a quality borehole. Many of these factors may be characterized as undesirable and non-productive dynamic behavior of the drill string.

An ideally desired dynamic behavior of the drill string, for most cases, includes the continuous and constant instantaneous speed rotation of the bit, along with a continuous and constant instantaneous rate of progression (or rate of penetration "ROP") of the bit through the formation. "Constant" for both speed and ROP does not necessarily mean unvarying over the entire well, but means, rather, the optimum of such values for the particular bit characteristics, formation being drilled, and other parameters (e.g. hole angle) of the moment. Over the drilling process, the ideal constants will likely undergo step changes and continuous changes over time. However, in segments of the drilling process between the step changes (e.g. formation boundaries), these constants should not change during the course of one or several drill bit revolutions. In short, the potential energy available in the drill string in its weight X displacement, and in its torque available X rotation angle, ideally will be consumed solely in the breaking and clearing of rock at the bit face in a continuous manner.

The reality of mechanical systems used in drilling, however, involves variables and degrees of freedom such that this ideal drill string behavior is often not obtained. The drill string's limberness, the complex curvatures of the borehole, and the variable boundary conditions (e.g. hole gauge and friction factors) provide for multiple dynamic systems up and down the drill string and borehole. Any arbitrary section of drill string and borehole may be characterized as such a dynamic system, with mass and inertia, stiffness factors, particular degrees of freedom and boundary conditions, and with energy inputs which are, at their simplest, the rotation and/or sliding from the surface, and may additionally include complex excitations which may modulate this energy, such as the bit engagement with a formation. The multiple dynamic systems up and down the drill string may be significantly coupled to or relatively uncoupled from each other. These systems and degrees of coupling may evolve and change over time and as the hole is drilled and the conditions change. There may be multiple responses to the energy input into each of these dynamic systems, which in addition to the desired 1:1 transmittal of rotary and translation energy to the bit, may include well-known detrimental conditions such as drill string whirl, bit bounce, torsional stick/slip of the bit and torsional waves up and down the string, and translational or torsional stick/slip of the drill string. These dynamic conditions may sap energy from the drilling process and frictional losses to the borehole wall, with the associated drill string (and borehole casing) abrasive wear, may cause higher than normal stresses in drill string components, and detract from the ideal bit-on-bottom behavior discussed above. In worst cases, these non-ideal dynamic conditions may include excitation to resonance, which may accelerate failures.

For example, there are various dynamics induced by the bit/formation interaction which may detract from the ideal drilling process. The tri-cone bottom-hole pattern can cause axial excitations at a frequency of 3 times bit RPM, which typically is in the 3–20 Hz base frequency range, with higher harmonics. These excitations may represent no more than the bit traversing circularly undulating (i.e. lobed) hole bottom with each revolution, while still remaining ideally engaged with the rock. But depending upon all the variables of the dynamic system, a bit-bounced dynamic could begin, with the bit losing ideal engagement with the bottom of the hole. Displacements could be on the order of 0.1 to 1 or even several inches. By placing a dynamic axial actuator in the BHA, the moment that this bit bounce condition is detected, a control signal can be sent initiating dynamic output from the axial actuator (i.e. displacements) synchronous with and opposite to the motion from the bit bounce, canceling or dampening the dynamic behavior. Alternatively, requiring less energy, and recognizing a "normal" condition of bit undulation while remaining ideally engaged, the axial actuator could dynamically and synchronously respond to absorb the displacement emanating from the bit and isolate this displacement from the rest of the string. In doing so this bit-induced dynamic is removed and not fed back into the dynamic system, thereby preventing a resonant condition and an inefficient drilling condition.

Generally, these destructive dynamic conditions may be characterized as (i) undesirable energy in the drill string or (ii) unfavorable drill string boundary conditions. Undesirable energy in the drill string may be undesirable axial energy, that is, undesirable energy flowing substantially longitudinally along the drill string, undesirable torque, that is, undesirable energy causing the drill string to twist in a ways that are not intended, or undesirable flexing of the drill string. Unfavorable drill string boundary conditions include friction, suction or any other condition that limits free motion of the drill string in the borehole and therefore limits the maximum transfer of energy from the drill string to the process of breaking and clearing of rock at the bit face in a continuous manner. Other drill string boundary conditions which may at times be unfavorable include particular combinations of hole gauge or shape, hole curvature or straightness, and drill string elements in contact, near contact, or not near contact with the borehole, which together contribute to the degree of freedom (particularly in radial or lateral axes) of the drill string in the borehole.

Often, these conditions are local in nature. That is, undesirable axial energy and undesirable torque energy tends to move in waves, or perturbations moving up and down the string at rates corresponding to the sonic velocity (which may vary) in and along the drill string. Even recognizing that such waves may travel significant distances along the string, each wave of such energy affects only a small portion of the drill string at any given moment. And importantly, controlled actions taken locally involving energy addition, damping, and/or modulations can have a useful affect in regard to these undesirable energy waves. Similarly, undesirable drill string boundary conditions tend to be localized. For example, a short segment of a drill string may experience friction at a point where the borehole bends. The friction may be localized to the area of the bend.

The system described herein provides local responses to oil well conditions which may be but are not necessarily local. The system identifies the oil well (i.e. borehole and/or drill string) condition at one or more locations, or for the borehole/drill string in aggregate, using sensors distributed along the drill string and provides one or more local responses using controllable elements distributed along the drill string. One way to visualize the system is as a "muscular" drill string, with the individual controllable elements being analogous to muscles in a human body. When it is desirable for the human body to perform a function, for example because of what the human body senses, a set of muscles are commanded to act. In most cases, only a few of the body's muscles are involved and the remaining muscles are not commanded.

Figure 2:
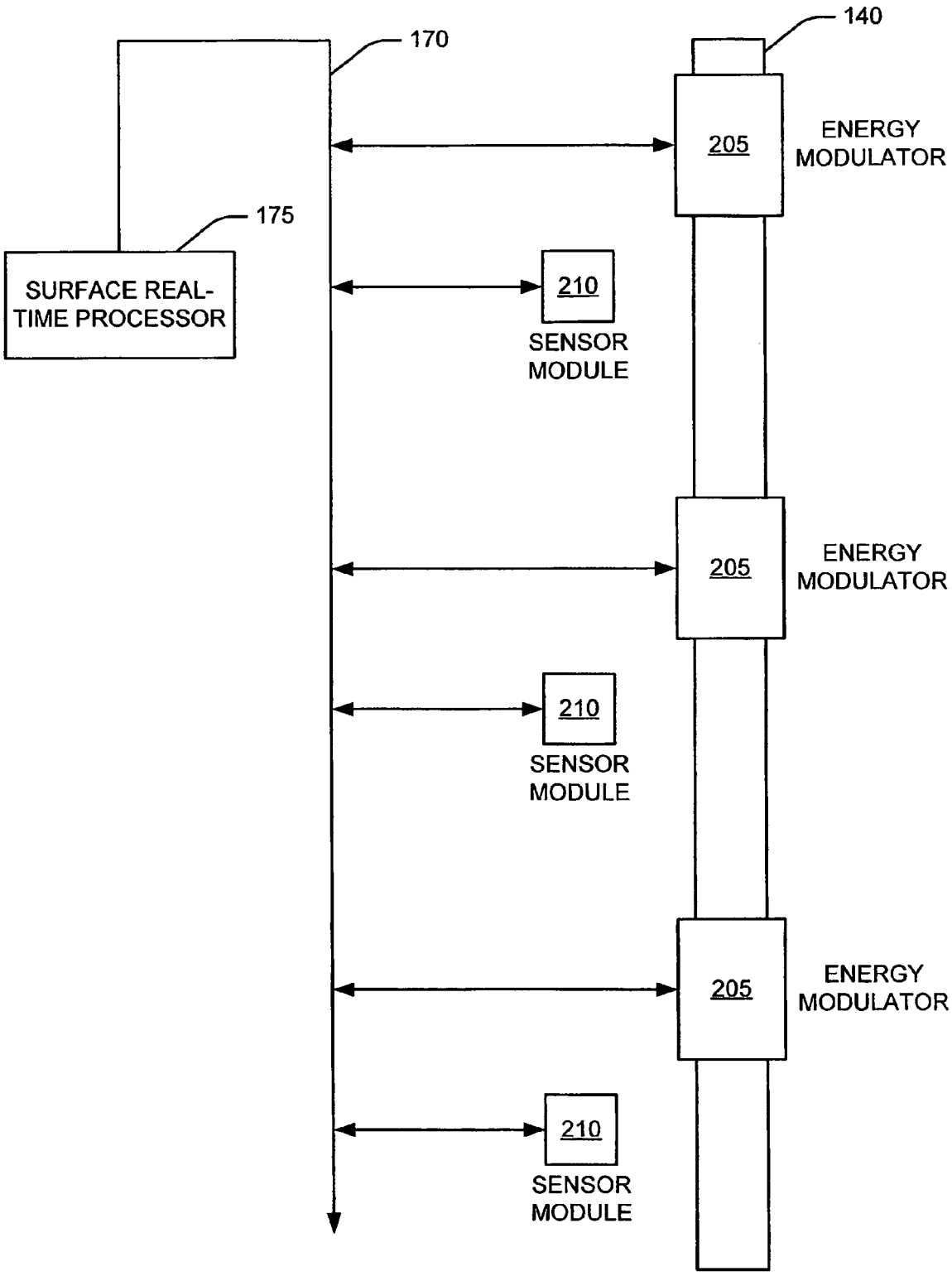
FIGS. 2 and 3 are schematic diagrams of control systems for providing a local response to a local condition in an oil well.
Figure 4:
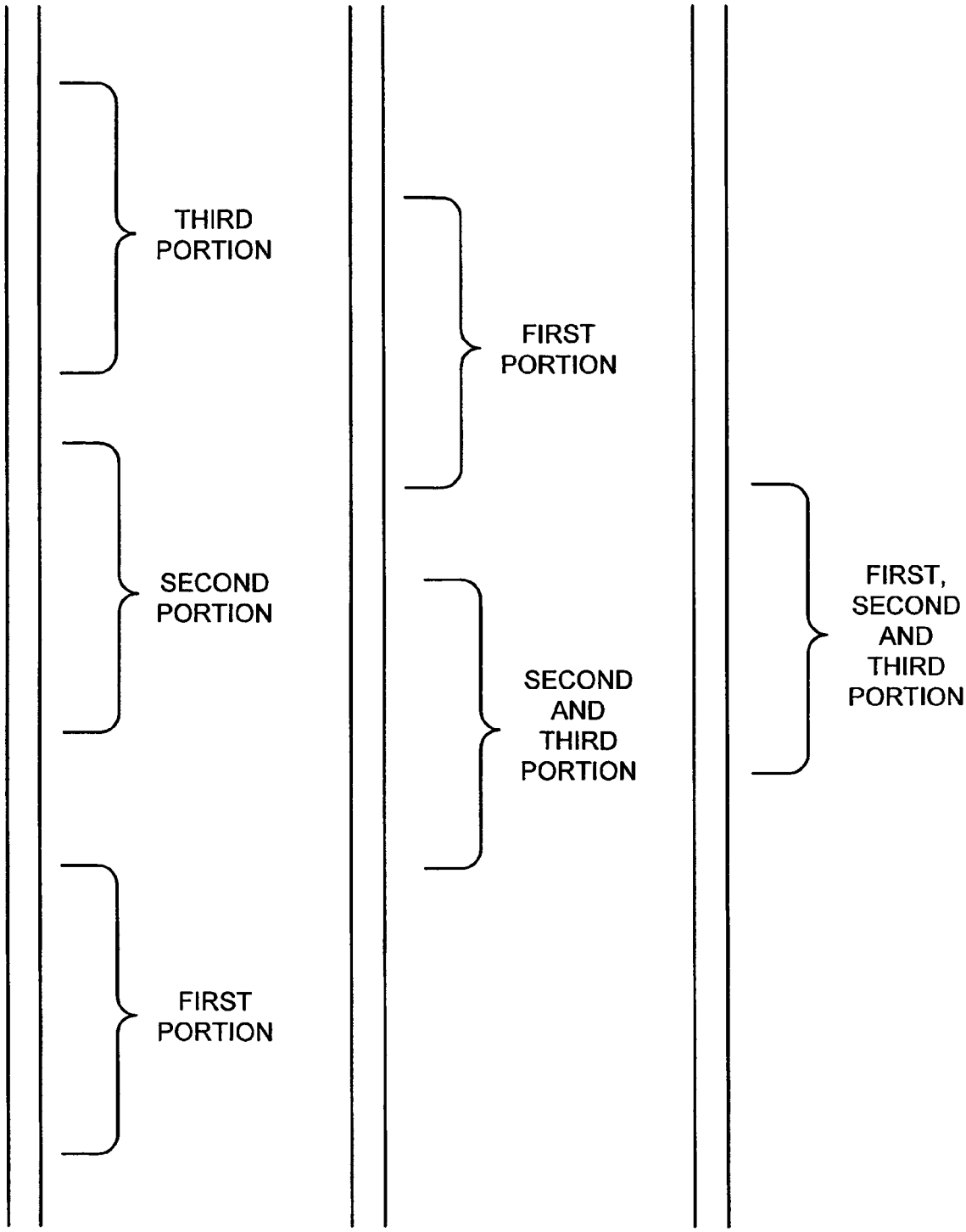
FIG. 4 illustrates portions of a drill string.
Figure 5:
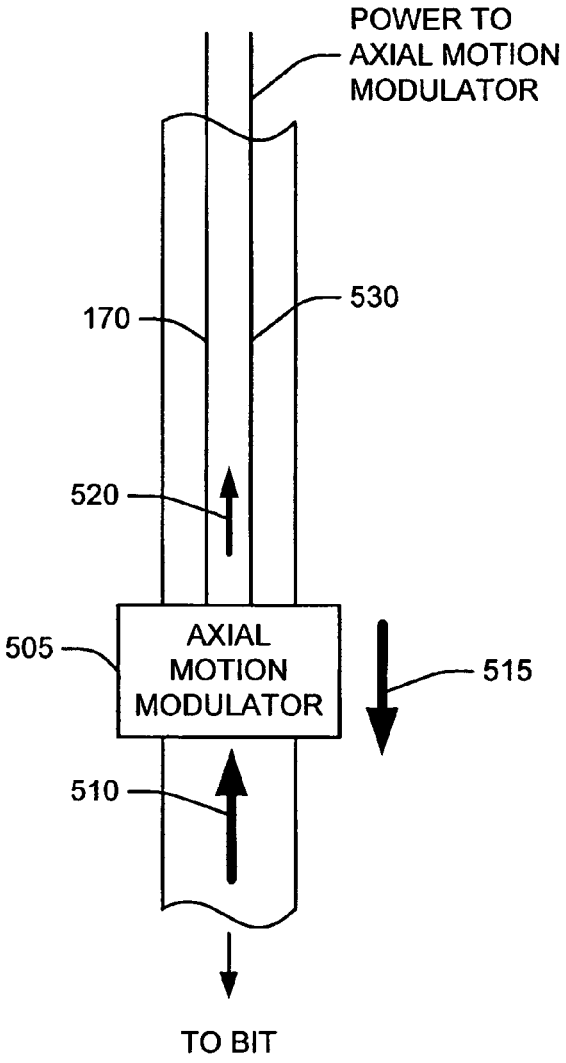
FIG. 5 illustrates an axial motion modulator.
Figure 6:
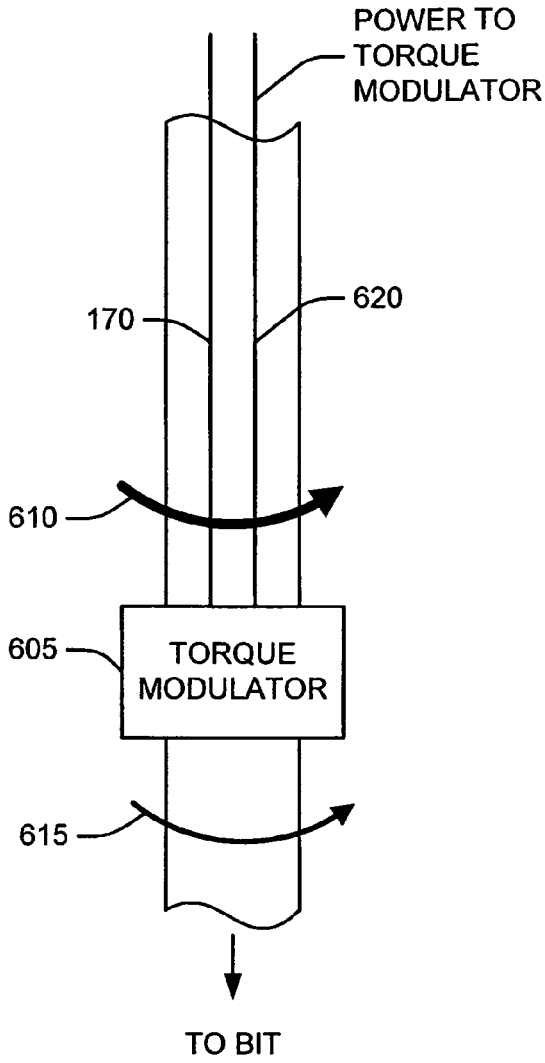
FIG. 6 illustrates a torque modulator.

An example system for providing a local response to a local condition, illustrated in FIG. 2, includes one or more energy modulators 205, which are described in more detail with respect to FIGS. 4, 5 and 6, distributed along the drill string 140. Generally, the energy modulators add, subtract or otherwise modify energy in the drill string, with each energy modulator being designed to address a specific drill string condition.

The energy modulators 205 may communicate with a real-time processor, e.g., the surface real-time processor 175 via the communications media 170, which may control at least some of the functions of the modulators 205. A set of sensor modules 210 is also distributed along the drill string 140 and may communicate with the surface real-time processor 175 via the communications media 170. In this example system, the surface real-time processor 175 acts as a "brain," receiving inputs from the sensor modules 210 and controlling the muscles associated with the energy modulators 205. It should be noted that the term "real-time" as used herein to describe various processes is intended to have an operational and contextual definition tied to the particular processes, such process steps being sufficiently timely for facilitating the particular new measurement or control process herein focused upon. For example, in the context of drill pipe being rotated at 120 revolutions per minute (RPM), and a undesirable drill string behavior or perturbation corresponding to three cycles per bit revolution, then a "real time" series of process steps of detection and response, canceling or damping a significant portion of this undesirable energy, would occur sufficiently timely in context of the ⅙ of a second duration for one of those perturbation cycles.

Figure 3:
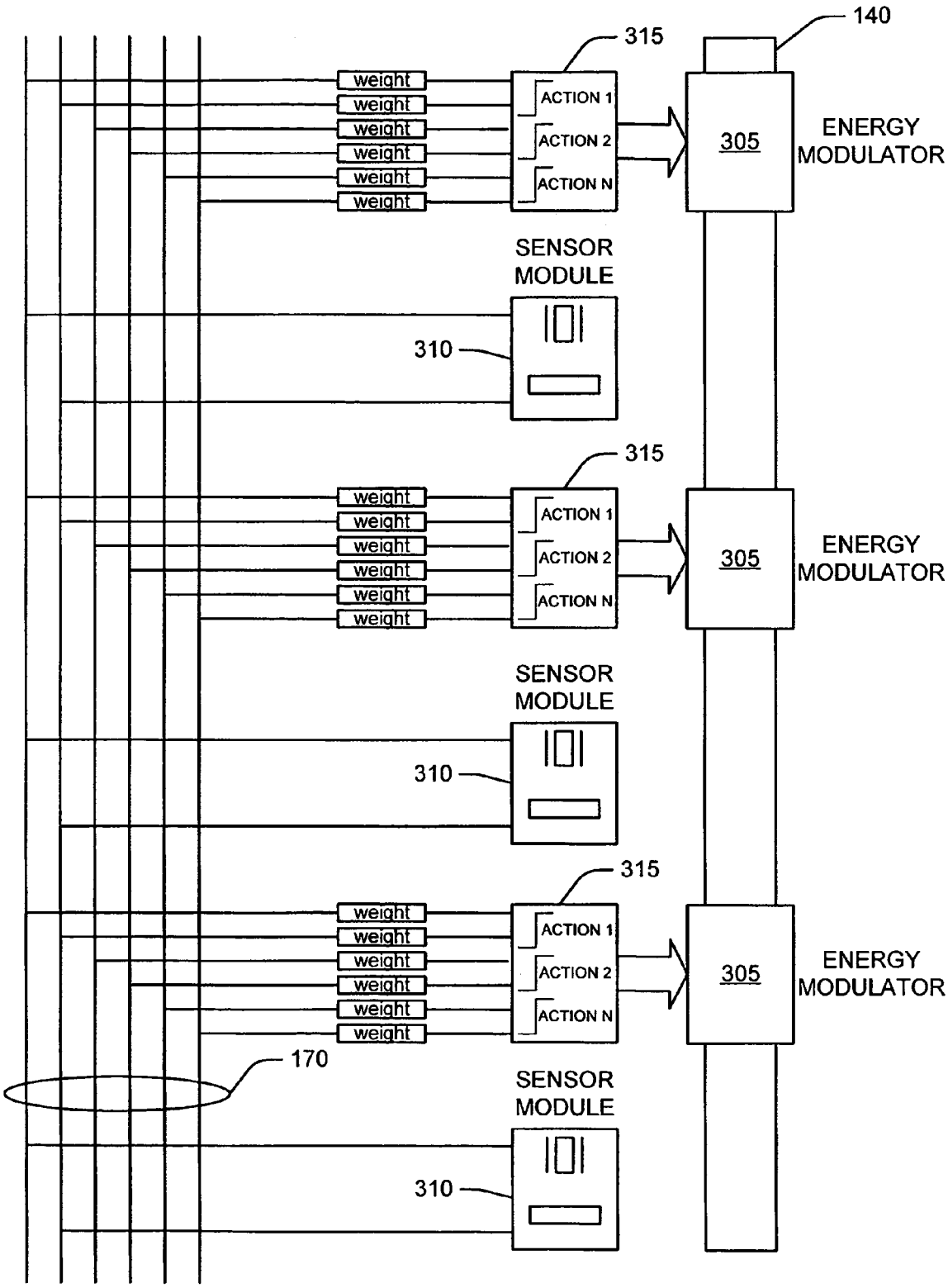

In another embodiment, illustrated in FIG. 3, the "muscles" are not controlled exclusively through commands from the surface real-time processor 175. In this embodiment, sensors and energy modulators are formed into an autonomous network that may operate with little or no supervision from the surface real-time processor 175. As in the previous embodiment, energy modulators 305 and sensor modules 310 are distributed along the drill string 140. Each sensor module 310 includes one or more sensors. As indicated in FIG. 3, the sensors in each sensor module 310 can be of many types, including pressure sensors, temperature sensors, strain sensors, force sensors, rotation sensors, translation sensors, accelerometers, shock sensors or counters, borehole proximity or caliper sensors, and many other types of sensors that are useful in drilling and logging of boreholes. Each energy modulator 305 may have an associated control unit 315 which may monitor the signals from one or more of the sensor modules 310 in the system.

The high speed communications media 170 threading the entire system allows each control unit 315 to monitor sensor modules 310 located at positions all along the drill string 140. The control units 315 command the muscles of the system to respond automatically to the stimuli detected by the sensor modules 310, with the possibility of a manual over-ride from the surface equipment. In its simplest embodiment, the control units 315 would employ a weighted sum voting procedure to decide whether to activate a particular muscle, and in what manner it should be activated. In the embodiment shown in FIG. 3, which shows three energy modulators 305 and three sensor modules 310, each sensor module 310 contains two different kinds of sensors. Each sensor module 310 provides a weighted output through the communications media 190 to each of the three control units 315 for the energy modulators 305. The weights may be determined with help of one or more drill string/borehole models, and/or by a function e.g., by training the system (as in a neural network), or by specification based on simulated responses. For example, in one embodiment, when the sum of the weights exceeds a pre-set threshold, a specific action is to be taken by the energy modulator 305. This action is directed by a series of commands from the control unit 315. While, for simplicity, the weights needed for just one response are shown in FIG. 3, a separate set of weights may be used for each response. These activities and functions can be carried out in the surface real-time processor using an arrangement as shown in FIG. 2.

A more general approach involves the use of a joint inversion of data collected from the sensor modules 310 to determine the desired action to be taken by the energy modulators 305. If the variables $v_1, v_2, \ldots, v_N$ are related by N functions $f_1, f_2, \ldots, f_N$ of the N variables $x_1, x_2, \ldots, x_N$ by the relation $$\begin{pmatrix} v_1 \\ v_2 \\ \cdots \\ \cdots \\ v_N \end{pmatrix} = \begin{pmatrix} f_1(x_1, x_2, \ldots, x_N) \\ f_2(x_1, x_2, \ldots, x_N) \\ \cdots \\ \cdots \\ f_N(x_1, x_2, \ldots, x_N) \end{pmatrix}$$

Then the process of determining specific values of $x_1, x_2, \ldots, x_N$ from given values of $v_1, v_2, \ldots, v_N$ and the known functions, $f_1, f_2, \ldots, f_N$ is called joint inversion. The process of finding specific functions $g_1, g_2, \ldots, g_N$ (if they exist) such that $$\begin{pmatrix} x_1 \\ x_2 \\ \cdots \\ \cdots \\ x_N \end{pmatrix} = \begin{pmatrix} g_1(v_1, v_2, \ldots, v_N) \\ g_2(v_1, v_2, \ldots, v_N) \\ \cdots \\ \cdots \\ g_N(v_1, v_2, \ldots, v_N) \end{pmatrix}$$

so that $(v_1, v_2, \ldots, v_N)=g_k(f_k(v_1, v_2, \ldots, v_N))$ for $1 \leqq k \leqq N$ is also called joint inversion. This process is sometimes carried out algebraically, sometimes numerically, and sometimes using Jacobian transformations, and more generally with any combination of these techniques.

More general types of inversions are indeed possible, where $$\begin{pmatrix} v_1 \\ v_2 \\ \cdots \\ \cdots \\ v_N \end{pmatrix} = \begin{pmatrix} f_1(x_1, x_2, \ldots, x_M) \\ f_2(x_1, x_2, \ldots, x_M) \\ \cdots \\ \cdots \\ f_N(x_1, x_2, \ldots, x_M) \end{pmatrix}$$

where M>N but in this case, there is no unique set of functions $g_1, g_2, \ldots, g_M$.

In general, as shown in FIG. 4, sensor modules 310 in a first portion of the drill string 140 detect parameters of the drill string in a second portion of the drill string 140. The detected parameters may be lumped parameters.

For example, assigning a friction coefficient to a precise point of measurement may not be useful. Defining such a coefficient may be more useful in describing the relation between force and sliding resistance over an area of the drillstring. Another example would be the relative deflection of a drill string from one point A along the drill string to another point B along the drill string. The concept of deflection may have little or no meaning at any point along the drill string. Furthermore, the deflection of the drill string from point x to point x+dx, where dx is an infinitesimally small distance, is itself infinitesimal; i.e. deflection is a continuous function. Thus, the deflection from A to B is a lumped parameter of the drill string.

In addition, the drill string may be modeled as a set of mass-spring-dashpot elements linked end to end, i.e. in series. Each of the mass-spring-dashpot elements may correspond to an arbitrary portion of the drill string, where the portion may be very small, on the order of inches or fractions of inches, or very large, on the order of hundreds or even thousands of feet. In that case the detected lumped parameters may be the parameters associated with each of the mass-spring-dashpot elements, such as, for example, spring constant, dashpot damping coefficient, etc.

Moreover, some parameters may be effectively measured at a single point and treating them as lumped parameters may not be necessary or as effective or useful. For example, temperature and strain can be associated with an infinitesimally small region of a drill string.

Further, energy modulators in a third portion of the drill string 140 may affect the parameters of the drill string 140 in the second portion of the drill string. The first, second and third portions of the drill string may overlap and may be identical, as shown in FIG. 4.

The energy modulators 205 and 305 fall into two general categories: energy modulators that produce, absorb or modify kinetic energy and energy modulators that produce, absorb or modify other kinds of energy. Among the energy modulators that produce kinetic energy are axial motion modulators, torque modulators, flex modulators, radial modulators and lateral motion modulators. Among the energy modulators that produce other kinds of energy are energy modulators that produce heat, light, electromagnetic fields and other forms of energy.

An example of an energy modulator that affects kinetic energy, specifically axial energy, is an axial motion modulator, as illustrated in FIG. 5. The axial motion modulator 505 counters a large axial motion 510 (for example the bit bouncing upwards) by an opposite axial motion 515 provided by the axial motion modulator 505. Alternatively, the axial motion modulator could absorb, rather than counteract, the large axial motion 510, as discussed below. As a consequence, the axial motion above the axial motion modulator 520 is reduced in intensity. The high-speed communications media 170 allows data from the axial motion modulator 505 to processed as shown in FIG. 2 or FIG. 3. Similarly, the high-speed communications media 190 allows control of the actions of the axial motion modulator 505 and, in particular, control of the opposite axial motion 515 produced by the axial motion modulator 505. A separate power connection 530 may be provided to allow the axial motion modulator to react with sufficient energy.

Another example of an energy modulator that affects kinetic energy, specifically torque, is a torque modulator 605, as shown in FIG. 6. The torque modulator 605 transfers a controllable amount of torque from one side of the torque modulator 605 to the other side. As a consequence, a large torsional perturbation 610 experienced above the torque modulator 605, for example as a result of the bit hitting a brief formation hard spot, could be reduced to a smaller amount of torque 615 below the torque modulator. The share of torque transferred by the torque modulator 605 would be controlled by a real-time processor e.g., the surface real-time processor 175 based on data transferred back and forth across the high-speed communications media 170. Further, a power connection to the surface 620 may be included to provide enough power for the torque modulator 605 to perform its function. Other embodiments of the invention may provide partial or full power to one or more energy modulators, for example the torque modulator 605, via other sources of energy e.g., a battery that is local to the torque modulator, a fuel cell, or power derived from the surface rotation or the mud flow in the borehole.

One example of an axial motion modulator 505 is a dynamic bumper sub. Conventionally, bumper subs provide a compliant axial linkage between BHA elements, usually with a spring and passive damping with fluid being forced through an orifice during relative motion.

One embodiment of a dynamic bumper sub provides, in addition to, and from an axial load path standpoint, in parallel with, the spring and passive damping elements, an active element. One example of an active element, shown in FIG. 7, is a fast responding axial solenoid assembly included in an annular package within the dynamic bumper sub.

Figure 7:
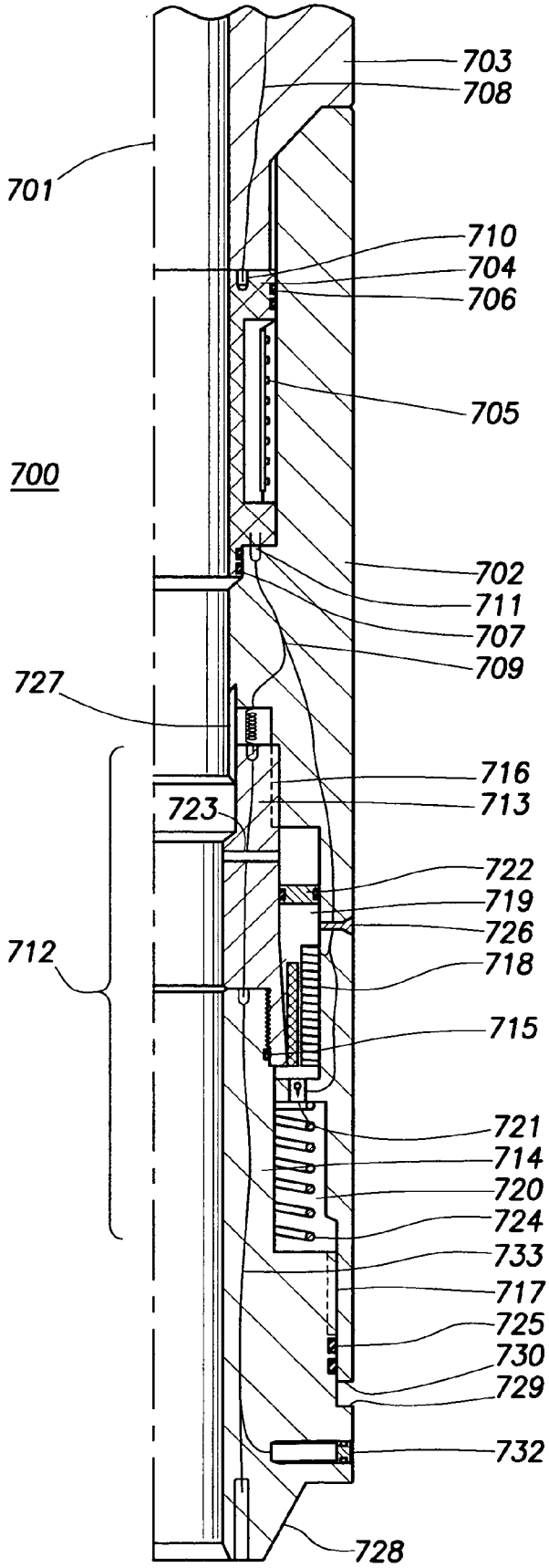
FIG. 7 illustrates a dynamic bumper sub using a solenoid.

Referring to FIG. 7, a dynamic bumper sub 700 using a solenoid is shown in cross section relative to a centerline 701. The bumper sub 700 includes a housing structure 702 connected to a pipe section 703 by a rotary shouldered connection. An electronics housing 704 may be positioned between the housing structure 702 and the pipe section 703. A printed circuit board 705 may be contained within the electronics housing 704. O-ring seals 706 and 707 prevent environmental fluids from entering the interior of the electronics housing 704. Electric power and communication wires 708, (which may be part of the communications media 170) may extend from the pipe section 703 to a connector in the electronics housing 704. A second set of electric power and communication wires 709 may extend from an electric connector in the electronics housing 704 into the housing structure 702. Electric connector 710 may be positioned at the top of the electronics housing 704 and electric connector 711 is positioned at the bottom of the electronics housing 704. A third set of electric power and communication wires 733 may extend from the second set to the bottom of the mandrel spring block section 714, and may extend to the bottom end (pin connection) of the bumper sub for continuity of power and communications to the next lower drill string element. The third set of electric power and communication wires 733, as shown, has a curly conduit section that bridges the gap between the mandrel structure 712 and the housing structure 702 to allow relative axial movement between the structures. In this particular embodiment, and in all embodiments of the invention, wires may be routed along exterior or interior of, along milled grooves within, and/or through holes drilled within the mechanical components and structures to traverse those components and structures. The wires may be secured in place by potting, banding, taping, and other techniques as known in the art and not specifically shown in the drawings. Connectors may be single conductor or multi-conductor, and may hermetically sealed where required, and are available from suppliers including Kemlon and GreenTweede.

A mandrel structure 712 is made up within the housing structure 702. The mandrel structure 712 may include a mandrel piston section 713 and a mandrel spring block section 714. The mandrel spring block section 714 may be threaded into the mandrel piston section 713 with o-ring seal 715 between. The mandrel structure 712 may be slidably mounted within the housing structure 702 to allow axial translation of the mandrel structure 712 relative to the housing structure 702. Lines 716 and 717 may be integrated between the housing structure 702 and the mandrel structure 712 to prevent relative rotational movement between the structures while allowing axial translation.

The bumper sub 700 may also include a solenoid 718 for axially displacing the mandrel structure 712 relative to the housing structure 702. As illustrated, the solenoid 718 may include an electrical conductor wound many times around the interior of the housing structure 702. In an alternative embodiment, the electrical conductors may be wound around the mandrel and/or both the mandrel structure 712 and the housing structure 702. Electric power may be communicated to the solenoid 718 through the second set of electric power and communication wires 709. The amount of current flowing to the solenoid, and therefore the amount of force generated by the solenoid, may be controlled by the printed circuit board 705, which may receive its instructions, for example, from the surface real-time processor, via the electric power and communications wires 708. The number of windings, the size of the wire used to form the windings, and the amount of current flowing through the windings may be chosen so that the solenoid can provide sufficient force to counteract forces traveling along the drill string. The amount of force generated by a solenoid is an increasing function of the number of windings and is also directly proportional to the current flowing through the windings. The wire making up the windings may be sized to sustain the amount of current required to produce the requisite amount of force. The printed circuit board 705 may also include one or more of the sensors discussed, preferably including axial acceleration sensors, which may be useful in control of the bumper sub.

The bumper sub 700 may further include an electronically controlled hydraulic dampener. A balance chamber 719 is separated from a spring chamber 720 by a throttle control 721. The balance chamber 719 may have a balance piston 722 which separates mud fluids in an upper portion of the balance chamber 719 from hydraulic fluid contained within the bottom portion of the balance chamber 719. Mud fluid circulating through the inner diameter of the mandrel structure 712 may be communicated to the upper portion of the balance chamber 719 through balance port 723. Hydraulic fluid in the lower portion of the balance chamber 719 may fluidly communicate with the hydraulic fluid in the spring chamber 720 through the throttle control 721. The throttle control 721 may be electronically controlled by the second set of electric power and communication wires 709 to control the cross-sectional area of the orifice through which hydraulic fluid flows through the throttle control 721. A spring 724 may be positioned within the spring chamber 720, wherein it engages the mandrel spring block section 714 and the housing structure 702. Thus, the spring 724 may bias axial movement of the mandrel structure 712 out of (telescope) the housing structure 702. O-ring seals 725 are positioned between the mandrel spring block section 714 and the housing structure 702 to seal the lower portion of the spring chamber 720. The bumper sub 700 may also have a fill plug 726 through which hydraulic fluid may be injected into the balance chamber 719 and spring chamber 720.

Given the mud and circulation fluids flow through the inner diameter of the bumper sub 700, a flow deflector 727 may be connected to the housing structure 702 to protect the junction between the housing structure 702 and the mandrel structure 712 from the erosive power of the mud flow. The lower portion of the mandrel structure 712 may also have a pin connector 728 for making up the bumper sub 700 to drill string.

The inward stroke of the mandrel structure 712 into the housing structure 702 is limited by contact between a stroke shoulder 729 and the housing and 730. Outward stroke of the mandrel structure 712 relative to the housing structure 702 is limited by contact between the lower end of the mandrel piston section 713 and the housing structure 702 at the throttle control 721.

The electronic control of the force generated by the solenoid and the hydraulic dampener provides dynamic control of the properties of the dynamic bumper sub 700.

The dynamic bumper sub 700 may also include a mini-sensor set 732. The sensors of the sensor set 732 may be positioned in the exterior of the mandrel spring block section 714 where it extends below the housing structure 702. The sensor set 732 may be electrically connected to the third set of electric power and communication wires 733. One or more of the sensors discussed may be included within this mini-sensor set 732, preferably including an axial acceleration sensor which preferably in conjunction with a similar such sensor in the electronics section printed circuit board 715 may be useful in controlling the bumper sub.

In another embodiment of the axial motion modulator 505, an annular hydraulic piston assembly is built into the pipe section. The annular piston may engage a cylinder whose volume is rapidly modulated per the control signal (provided over the data interface 525), with the change in volume accomplished, for example, by opening and closing large volume valves. A high-volume electrically driven positive displacement hydraulic pump may be running continuously and valve-end to the cylinder as required.

With an electric motor driving at, for example, 3,000 RPM, and, for example, quantity 16 of 0.5 inch diameter pump pistons disposed in an annular array on a four inch nominal diameter (e.g. within a 6.75 inch collar section), and a swash plate stroke of 0.2 inches, around 31 cubic inches of fluid per second can be produced. The response frequency and amplitude would depend then upon the annular piston area. An annular piston with a differential area of one square inch, and a maximum stroke of, for example, one inch could respond full stroke (one way) within 0.03 seconds, which would be sufficient for offsetting typical bit-bounce frequencies. Multiple such units could be employed to increase volume capacity and/or to increase the annular piston differential area and thereby the force capability. Valving and/or use of two such pump units could be employed to actively drive the annular piston in both directions.

Another example would include a hydraulic pump, as described above, but rather than the pump output directly acting upon the annular piston, the pump output would be directed to fill a large annular storage chamber, pressured above ambient by its own spring and piston system. The volume held in the storage chamber might be many times that required to be used for countering a typical dynamic condition flare-up and, therefore, the hydraulic oil could be applied to the task of displacing the bumper sub's annular piston (under pressure of the storage system spring) at a volumetric rate limited only by the hydraulic flow path resistances (i.e. not limited by the output rate of pumps). A two foot length of 6¾ inch collar would allow for on the order of 400 cubic inches of fluid storage, which, without considering refill rate by the pumps, would provide for 200 roundtrip one-inch stroke cycles with a one-inch area annular piston described above. The required system response to canceling unwanted dynamics requires many of the other system elements discussed earlier, including preferably the nearby sensing capability, the high-speed communications media 170 for sensor modules and control signals to and from a surface real-time computer 175, and a significant electrical power source to drive the motor, as illustrated in FIG. 5.

Figure 8:
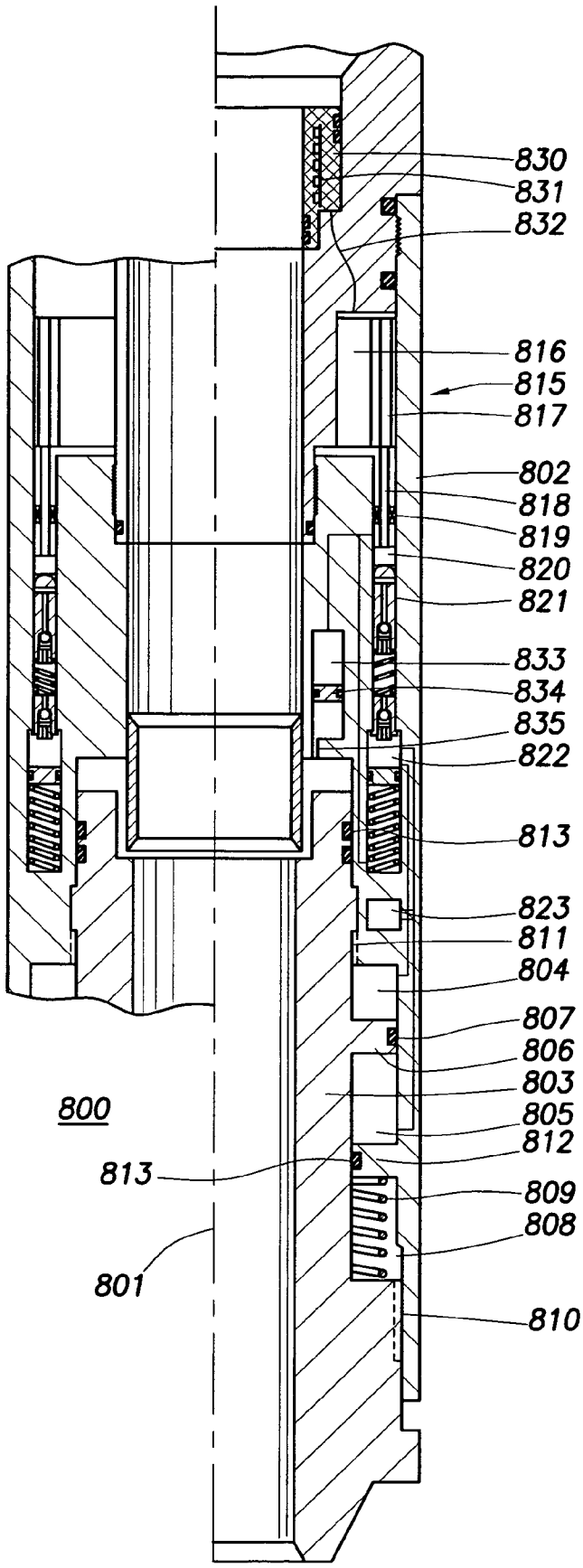
FIG. 8 illustrates a dynamic bumper sub using a hydraulic pump.

An example of such a dynamic bumper sub is illustrated in FIG. 8. Referring to FIG. 8, a cross-sectional, side view about center line 801 of a dynamic bumper sub 800 using hydraulic actuation is illustrated. The sub 800 has a housing 802 and a mandrel 803 that slides in the axial direction relative to the housing 802. Two chambers may be defined between the mandrel 803 and the housing 802: a telescoping chamber 804 and a retracting chamber 805. A mandrel flange 806 may extend radially outward from the mandrel 803 to divide the two chambers. Further, the mandrel flange 806 may have an o-ring seal 807 around its circumference to prevent leakage between the chambers. The mandrel 803 may telescope out of the housing 802 when hydraulic fluid is pumped into the telescoping chamber 804 and the mandrel 803 retracts into the housing 802 when hydraulic fluid is pumped into the retracting chamber 805. A spring (not shown) may be located in the retracting chamber 805 to resist the telescoping of the mandrel 803 out of the housing 802. In that case, it may not be necessary to pump hydraulic fluid into the retracting chamber 805.

A spring chamber 808 may also defined between the mandrel 803 and the housing 802. A housing flange 812 may extend radially inward from the housing 802 to divide the retracting chamber 805 from the spring chamber 808. The housing flange 812 may have an o-ring seal 813 at its interior circumference to prevent fluid flow between the chambers. A spring 809 may be positioned within the spring chamber 809 to bias the mandrel 803 in the telescoping direction. Two splines 810 and 811 may be configured between the mandrel 803 and the housing 802 to prevent the members from rotating relative each while allowing relative movement in the axial direction. The bottom of the spring chamber 808 is in fluid communication with the annulus on the exterior of the sub to allow mud fluid to flow into the chamber.

The sub 800 may include a motor 815 for producing the hydraulic pressure needed to charge the chambers. The motor 815 includes a stator 816, which is mounted to the housing 802, and a rotor 817, which is positioned coaxially on the outside of the stator 816. The rotor 817 is mounted on an annular drive shaft 818 that is supported by bearings 819.

At the opposite end from the rotor 817, a swash plate 820 is connected to the drive shaft 818. Because the drive shaft 818 is longer on one side than the other (i.e. the cylindrical structure has a mitered lower end face), the swash plate 820 moves up and down relative to the housing 802 as the motor 815 spins the swash plate 820. A plurality of pump rams 821, 16–20 pump rams in one embodiment, may be positioned radially around the housing 802 immediately below the swash plate 820 within smoothly drilled bores in the housing structure. The heads of the pump rams 821 are engaged by the swash plate 820 so that as the swash plate 820 moves up and down during its rotation, individual pump rams 821 are charged and released. When the swash plate 820 rotates 360 degrees, each of the individual pump rams 821 are charged once.

The motor 815 may also be protected with an oil that is pressure balanced through a balance chamber 833. The balance chamber 833 has a balance piston 834 separating oil in an upper portion from mud in a lower portion. The lower portion of the balance chamber 833 fluidly communicates with the ID of the sub via balance port 835. The upper portion of the balance chamber 833 fluidly communicates with the space containing the motor 815, and with the region of the pump ram heads (i.e. pump ram inlets).

The pump rams 821 pump hydraulic fluid into an annular, spring loaded, hi-pressure storage chamber 822 that may be defined within the housing 802. The hi-pressure storage chamber 822 is a reservoir from which hydraulic fluid under high pressure is drawn to charge the telescoping chamber 804 and the retracting chamber 805. In other embodiments, the hi-pressure storage chamber 822 is omitted. A manifold is positioned within a valve block 823, wherein the manifold connects the various valves and conduits required to circulate the hydraulic fluid in accordance with the required hydraulic logic described more fully below. Conduits may be hydraulic hoses, or other means known in the art of communicating hydraulic fluid flow including via holes drilled through or grooves milled upon the structures shown, and/or reliefs between diameters or faces of adjacent components, all such communication paths including appropriate cooperative seals to contain the hydraulic fluid to its designated path. In particular, one set of inlet and exhaust conduits connects the manifold to the telescoping chamber 804 and another set of inlet and exhaust conduits connects the manifold to the retracting chamber 805. A recirculation conduit 900 (See FIG. 9A) connects the manifold to the inlet region of the pump rams 821.

The dynamic bumper sub 800 may also have an electronics housing 830 that protects a printed circuit board 831, which may contain electronic components for control and sensing elements as described in an earlier bumper sub embodiment. A power and control wire 832 communicates between the electronics housing 830 and the motor 815.

Figures 9A, 9B:
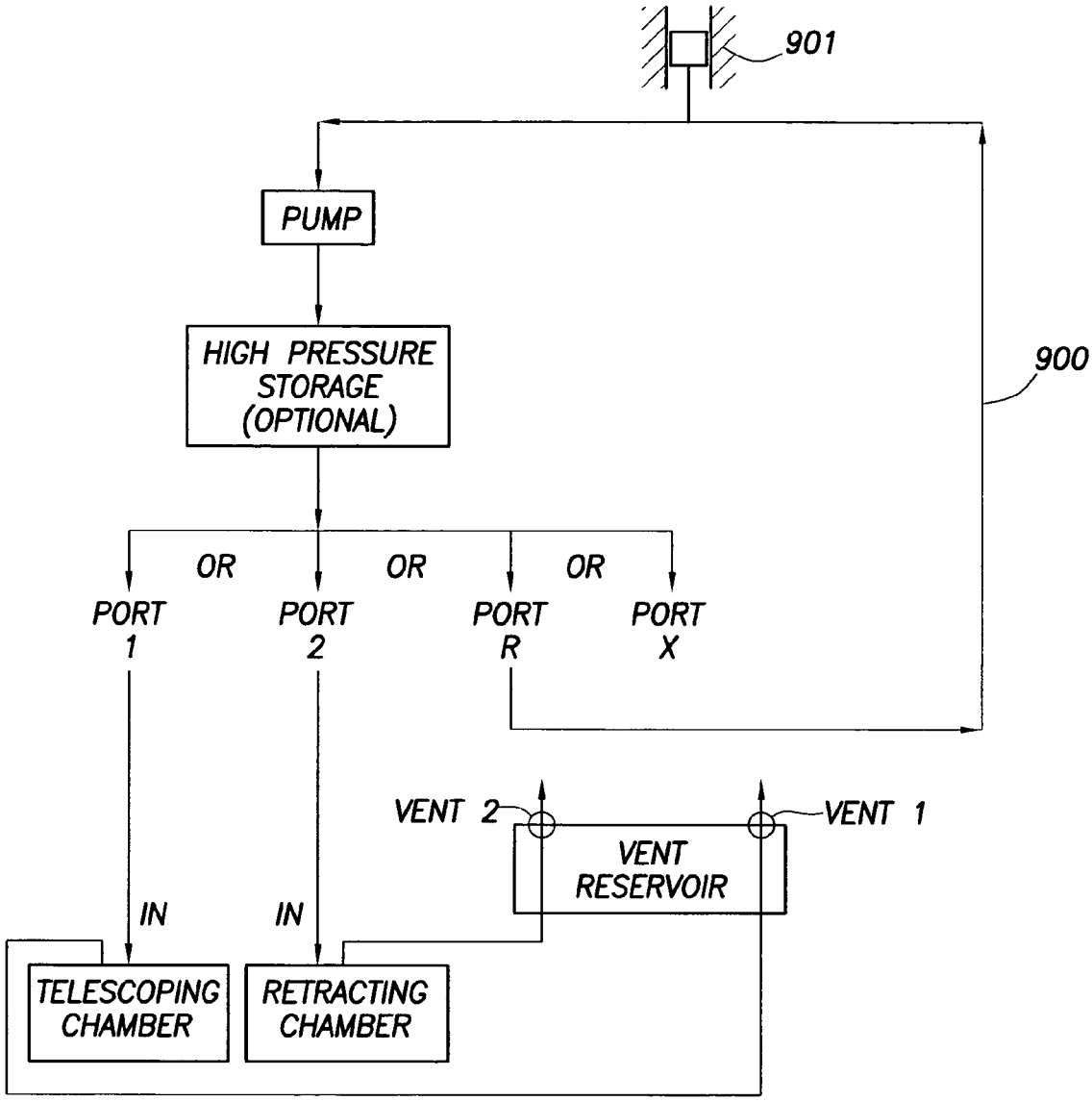
FIG. 9 illustrates hydraulic logic for the dynamic bumper sub shown in FIG. 8.

Referring to FIGS. 9A and 9B, the hydraulic logic for the manifold and system of the dynamic bumper sub 800 shown in FIG. 8 are illustrated in schematic form. In particular, FIG. 9 shows that the manifold may have three inlet ports: port 1, port 2, and port R. When port 1 is open, fluid is pumped into the telescoping chamber 804. When port 2 is open, fluid is pumped into the retracting chamber 805. As indicated above, this portion of the hydraulic logic may not be necessary if a spring is located in the retracting chamber 805. When port R is open, fluid is recirculated to the pump rams 821 through recirculation conduit 900. This is useful when the hi-pressure storage 822 is full. When all three of the ports are closed (port X), the pump rams 821 refill the hi-pressure storage 822 from the vent reservoir. The manifold also has two vent ports: vent 1 and vent 2. When vent 1 is open, fluid bleeds out of the telescoping chamber 804. When vent 2 is open, fluid bleeds out of the retracting chamber 805. Through the manifold, the vents are connected to a vent reservoir that is also connected to the recirculation conduit 900. A schematically shown balance chamber 901, which may be identical with (or in direct fluid communication with) balance chamber 833 shown in FIG. 8, is connected to the recirculation conduit 900. As shown in FIG. 9B, the ports and vents are electrically controlled so that the vents are logically tied to the ports. Specifically, when port 1 is open, vent 2 is open. When port 2 is open, vent 1 is open. When port R is open, vents 1 and 2 are open. When all three ports are closed, vents 1 and 2 are open. A volume balance preferably is maintained during operation, wherein the volumes of telescoping chamber 804 and retracting chamber 805 added together remain constant, and volumes of hi-pressure storage chamber 822 and balance chamber 833 added together remain constant, and those two aggregate volumes, themselves added together, remains constant (allowing however for volume changes due to slight seal leakage over time and bulk compression/expansion of the hydraulic oil under ambient pressure and temperature conditions. The electrical controls may be actuated via the communications media 170 by the surface real-time processor 175, which provides dynamic control of the properties of the bumper sub 800.

An example of a torque modulator 1605 is a dynamic clutch. A dynamic clutch could be employed in the BHA or elsewhere in the drill string to help mitigate torsional dynamic behaviors of the string typically evolving from the bit or other element of the string instantaneously being slowed or stopped from its normal rotation rate. The clutch could be used in conjunction with a rotary steerable device or a mud motor. Gear-type clutches are known for use in drilling tools for engaging and disengaging rotational coupling between drill string members. One embodiment of the dynamic clutch preferably employs friction plates, which may be held in engagement by an electrical actuator or electrical over hydraulic actuator. Control or modulation of the electrical signal by the surface real-time processor 175 via the high-speed communications media 170 allows controlled or modulated release of engagement and re-engagement, de-coupling and then re-coupling the rotary engine of the drill string above the clutch, to the string, or BHA below the clutch.

Figure 10:
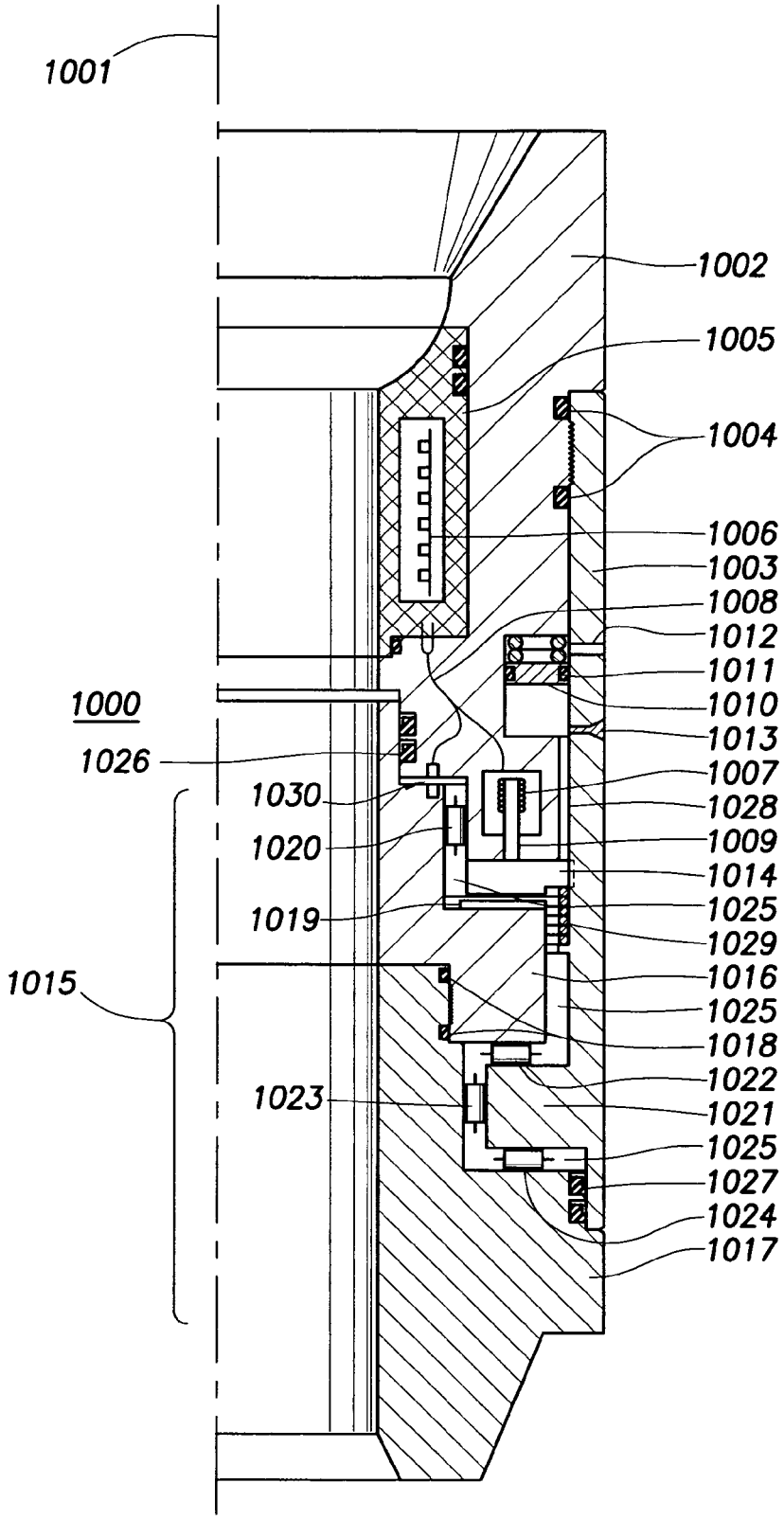
FIG. 10 illustrates a dynamic clutch sub.

FIG. 10 is a cross-sectional, side view of an embodiment of a dynamic clutch sub 1000 having a center line 1001. The sub has a box connector 1002 at the top for making up to pipe string. A housing 1003 is threaded onto the exterior of the box connector 1002 wherein o-ring seals 1004 complete the connection. An electronics insert 1005 may be connected to the interior of the box connector 1002. A printed circuit board 1006 may be housed within the electronics insert 1005. The printed circuit board may be controllable via the communications media 170 by the surface real-time processor 175 using arrangements such as those shown in FIGS. 2 and 3. The printed circuit board 1006 may include one or more sensors as discussed, preferably for sensing rotational orientation, rotary speed, tangential accelerations, or torsional strains, as may be useful in control of a dynamic clutch sub. A balance chamber 1010 may be defined between the box connector 1002 and the housing 1003. The balance chamber 1010 may be split into a mud fluid section in the top and a hydraulic fluid section in the bottom by a balance piston 1011. The upper section of the balance chamber 1010 fluidly communicates with the exterior (annulus between the sub and casing, not shown) of the sub 1000 via balance port 1012. Hydraulic fluid may be injected into the balance chamber 1010 through a fill plug 1013. The balance chamber 1010 may also have a spring in the upper mud portion to bias the balance piston 1011.

A rotating mandrel 1015 may be made up to the inside of the box connector 1002 and the housing 1003. The rotating mandrel 1015 may have two parts, a friction section 1016 and a pin connector 1017. The friction section 1016 and the pin connector 1017 may be threaded into each other and o-rings 1018 may complete the connection. A friction plate 1019 may have a ring-like structure and may be attached to an upward facing surface of the friction section 1016. A radial bearing 1020 may be positioned between the friction section 1016 and the box connector 1002. A thrust bearing 1022 may be positioned between the bottom end of the friction section 1016 and a housing flange 1021 that extends radially inward from a lower end of the housing 1003. A radial bearing 1023 may be positioned between pin connector 1017 and the housing flange 1021. A thrust bearing 1024 may be positioned between an upward face of the pin connector 1017 and the housing flange 1021.

A bearing chamber 1025 may be defined between the housing 1003, the box connector 1002, and the rotating mandrel 1015. An upper end of the bearing chamber 1025 may be sealed by rotary seals 1026 between the friction section 1016 and the box connector 1002. A lower end of the bearing chamber 1025 may be sealed by rotary seals 1027 between the pin connector 1017 and the housing 1003. The bearing chamber 1025 may be fluidly connected to the balance chamber 1010 via gap 1028. The balance chamber 1010 enables hydraulic fluid to be maintained in and around the bearing regardless of the pressure being generated on the exterior of the sub 1000.

An array of solenoids 1007 may be connected to the bottom of the box connector 1002. A communication/power bus 1008 communicates control signals between the printed circuit board 1006 and the array of solenoids 1007, and in one embodiment also communicates rotary electrical interface 1030 between the opposing faces of the box connector 1002 structure and the rotating mandrel 1015. This rotary electrical interface may comprise simply a relative rotation sensor. In other embodiments, the communication power bus 1008 also extends through this rotary electrical interface 1030 into the rotating mandrel 1015 for connection to a sensor set (not shown) which may preferably sense similar parameters to those named earlier which may be included with printed circuit board 1006, but here such parameters associated with the rotating mandrel. And this extension of communication/power bus 1008 may further extend along the mandrel 1015 and connect to other drill string elements connected to the bottom of the sub. In such embodiments the rotary electrical interface 1030 may comprise an inductive type or brush type interface. An array of pistons 1009 may extend from the array of solenoids 1007 and have clutch plates 1014 attached thereto. The clutch plates 1014 may be positioned opposite the friction plate 1019 so that when the array of solenoids 1007 is engaged, the clutch plates 1014 extend to contact and press against the friction plate 1019. This action restricts relative rotational movement between the rotating mandrel 1015 and the box connector 1002. A return spring 1029 may be positioned between a flange on the housing 1003 and the clutch plates 1014 to release the clutch plates 1014 from the friction plate 1019 when the array of solenoids 1007 is deactivated. The clutch plates 1014 may also engage in a spline 1028 between the clutch plates 1014 and the housing 1003 to prevent rotational movement while allowing axial movement.

The amount of torque translated from one side of the dynamic clutch sub to the other depends on the control signals applied to the array of solenoids 1007. The control signals may be provided by an independent controller on PCB 1006 or may be provided through the PCB 1006 and the communications media 170 by the surface real-time processor 175. A set or series of clutch and friction plates operating together (not shown) may alternatively be employed, to increase the contact area and thereby reduce the contact pressure requirement in achieving the mechanical torque capacity required. In another embodiment (not shown), the return springs 1029 may be positioned so as to create a default contact condition between clutch plates 1014 and friction plates 1019, thus allowing for slippage and relative rotation only when the solenoids are activated.

An example of the utility of a dynamic clutch arises when a bit engages a particularly hard formation top and briefly stalls. Without a clutch, and recognizing that the drill string is being rotated from perhaps 15,000 feet away, this brief stall would create a drill string wind-up event, which, depending upon the duration of the stall, would represent energy stored from a part of a revolution to several revolutions of angular perturbation. The resultant stored energy, upon release, would potentially overspeed the bit (with possible damage resulting), and a torsional "unwind" wave would be launched up the drill pipe. These torsional waves could contribute to overtightening and/or loosening pipe connections, which could lead to failure. A conventional torque limiter would mitigate this to an extent, and the clutch would slip or ratchet until actions are taken by the driller to reset (e.g. pick up off bottom). An electronic feedback control system provides a deliberate and calibrated release of the torque with torque transmittal through the clutch being maintained through the event (while allowing for rotational slipping) and allowing for the bit to resume rotation on its own, or perhaps under a controlled increase in torque transmitted through the clutch. A more sophisticated control process might include an automated command to the rotary table, the draw works, or a downhole dynamic bumper sub, to cause a release in weight on bit.

Another example of the clutch's utility is in the modulation of the speed of the bit. In certain circumstances (e.g. the tri-cone lobe effect as noted above) the prevailing bit RPM may initiate a resonant condition. In such circumstances it might make sense to deliberately vary the RPM over time, or even modulate the instantaneous RPM for variations within the duration of a single revolution. The clutch could likewise be engaged to accomplish this.

Yet another type of energy modulator is a vibrator sub. Drill string tools are known which can electrically or mechanically excite vibrations in the drill string. For example, it is known to utilize a piezo-ceramic stack in an annular configuration to convert electrical power into vibrational energy, which is amplified via a spring/mass ("compliant element/tail mass") system associated with that stack. In the current invention, such a system could be excited to a particular frequency or modulation scheme in a controlled manner with that controlled vibrational energy coupled into the drill string for the dynamic compensation or cancellation purposes of the invention.

Drill string tools are known which are driven by the mud flow and utilize simple spring and valve systems to create periodic impacts, which perturbations can be coupled axially and/or torsionally along the drill string. Such devices may be generically called fluid hammers. The current invention improves on this type of device. Whereas these vibration subs provide an impact periodicity which is related to the flow rate, the current invention can harness the energy of the flow and apply that energy as a controlled frequency torsional or axial output. One device would include a center slide hammer element (either a central sonde, or annular configuration) which has two stable states, up and down, depending upon the presence or absence of a particular pressure-drop inducing feature (i.e. a pilot), which itself can be activated or deactivated rapidly either via electric solenoid, or a hydraulic system controlled by electric solenoid. In transitioning from state to state, a pressure drop over the slide hammer element would cause it to slide up or down. With the pilot mechanism frequency able to be controlled and modulated, a controlled hammer vibration can be established, and this dynamic hammer can be utilized to inject energy into the drill pipe dynamic system in a controlled manner for the dynamic compensation or cancellation purposes of the invention.

Establishing mechanical vibrations in the drill string will be dependent upon the mass, stiffness, degrees of freedom, and boundary conditions of the local drill string dynamic system. The local dynamic system characteristics may be modeled generically, and as part of a real time process the system could be periodically characterized by analyzing the system dynamic response (via several strategically placed sensors) to particular known vibrational input frequencies, and developing or updating a local transfer function. The particular control inputs then for the dynamic compensation or cancellation purposes or other purposes under the invention would be tailored and controlled in real time recognizing the overall system dynamic response, not just the response of the vibration input device.

Figure 11:
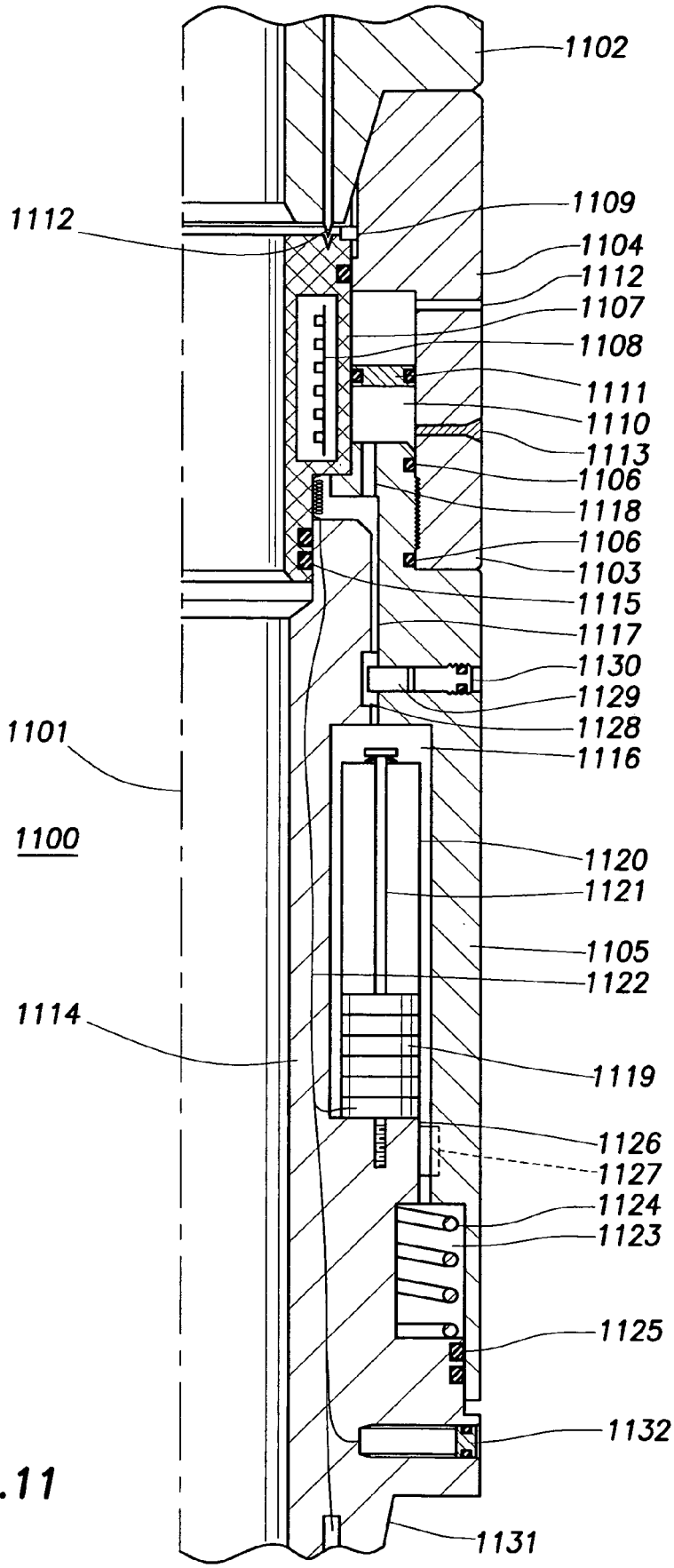
FIG. 11 illustrates a dynamic vibrator sub.

Referring to FIG. 11, an example vibrator sub 1100 is illustrated in cross-section with center line 1101. A portion of a pin sub 1102 is also shown to which the vibrator sub 1100 is made up. The vibration sub 1100 has a housing 1103 made of two sections which are threaded together. The upper housing 1104 has a female thread into which male threads on the lower housing 1105 are threaded. O-ring seals 1106 complete the connection. An electronics insert 1107 may be positioned between the upper housing 1104 and the lower housing 1105, and may be clamped in and keyed to the upper housing 1104 via locking ring 1109. A printed circuit board 1108 may be contained within the electronics insert 1107. A connector 1112 extends from the pin sub 1102 for electrical communication with the electronics insert 1107. The printed circuit board may be controllable via the communications media 170 by the surface real-time processor 175 using arrangements such as those shown in FIGS. 2 and 3. The printed circuit board may include one or more of the sensors discussed, and may preferably include an axial vibration sensor or accelerometer useful for control of the vibrator sub. A balance chamber 1110 may be defined between upper housing 1104, lower housing 1105, and electronics insert 1107. The balance chamber 1110 may be divided into a mud portion above and a hydraulic portion below by a balance piston 1111. The mud portion of the balance chamber 1110 above the balance piston 1111 communicates with the borehole annulus mud via balance port 1112. The oil side of the balance chamber 1110 below the balance piston 1111 communicates with the inner diameter of the vibration sub 1100 via balance port 1108. Hydraulic fluid is inserted into the balance chamber 1110 through fill plug 1113.

A mandrel 1114 may be made up within a lower housing 1105. The upper portion of the mandrel 1114 is inserted between lower housing 1105 and electronics insert 1107, wherein o-ring seals 1115 seal the connection between the mandrel 1114 and the electronics insert 1107. A stack chamber 1116 may be defined between the lower housing 1105 and the mandrel 1114. The stack chamber 1116 may be in fluid communication with the balance chamber 1110 via a gap 1117 between the mandrel 1114 and the lower housing 1105. The two chambers may be in further fluid communication to the balance chamber 1110 (oil side) through port 1118 in an upper portion of the lower housing 1105.

Within the stack chamber 1116, an annular stack of piezo electric crystals 1119 may be secured to the mandrel 1114. An annular tail mass 1120 may be positioned immediately on top of the piezo electric crystals 1119. Tension bolts 1121 may extend through the tail mass 1120 and the piezo electric crystals 1119 and thread directly into the bottom of the stack chamber 1116 defined by the mandrel 1114. The tension bolts 1121 keep the piezo electric crystals 1119 and tail mass 1120 in compression. An electrical communication/power bus 1122 extends from the electronics insert 1107 to the piezo electric crystals 1119.

A spring chamber 1123 may also defined between the lower housing 1105 and the mandrel 1114. A spring 1124 may be positioned within the spring chamber 1123 to engage the mandrel 1114 at the bottom and the lower housing 1105 at the top. The spring chamber 1123 may be sealed by o-ring seals 1125 at the bottom. The spring chamber 1123 may be in fluid communication with the stack chamber 1116 through a gap 1126 between the mandrel 1114 and the lower housing 1105. A spline 1127 may be configured in the gap 1126 to prevent relative rotational movement between the mandrel 1114 and the lower housing 1105 while allowing relative movement in the axial direction.

An upper portion of the mandrel 1114 may have a notch 1128 for receiving multiple keys 1129 which extend from the lower housing 1105. The keys may be secured in the lower housing 1105 by sealed plugs 1130. The keys 1129 prevent rotation and retain the mandrel 1114 within the housing 1103 when the vibration sub 1100 is in tension. The vibration sub 1110 is placed in tension, for example, when pipe string is made up to the pin connector 1131 and suspended below the vibration sub 1100 and especially when the pipe string is being tripped in or out of the borehole.

The vibration sub 1100 may also include a mini-sensor set 1132. The sensors of the sensor set 1132 are positioned in the exterior of the mandrel 1114 where the mandrel extends below the housing 1103. The sensor set 1132 may be electrically connected to the communication/power bus 1122 by copper with a seal plug, and preferably includes the sensors as noted above that might be useful in monitoring and/or controlling the vibration sub.

As before, the characteristics of the dynamic vibration sub may be controlled via the circuit board 1108 and the communications media 170 by the surface real-time processor 175.

Figure 12:
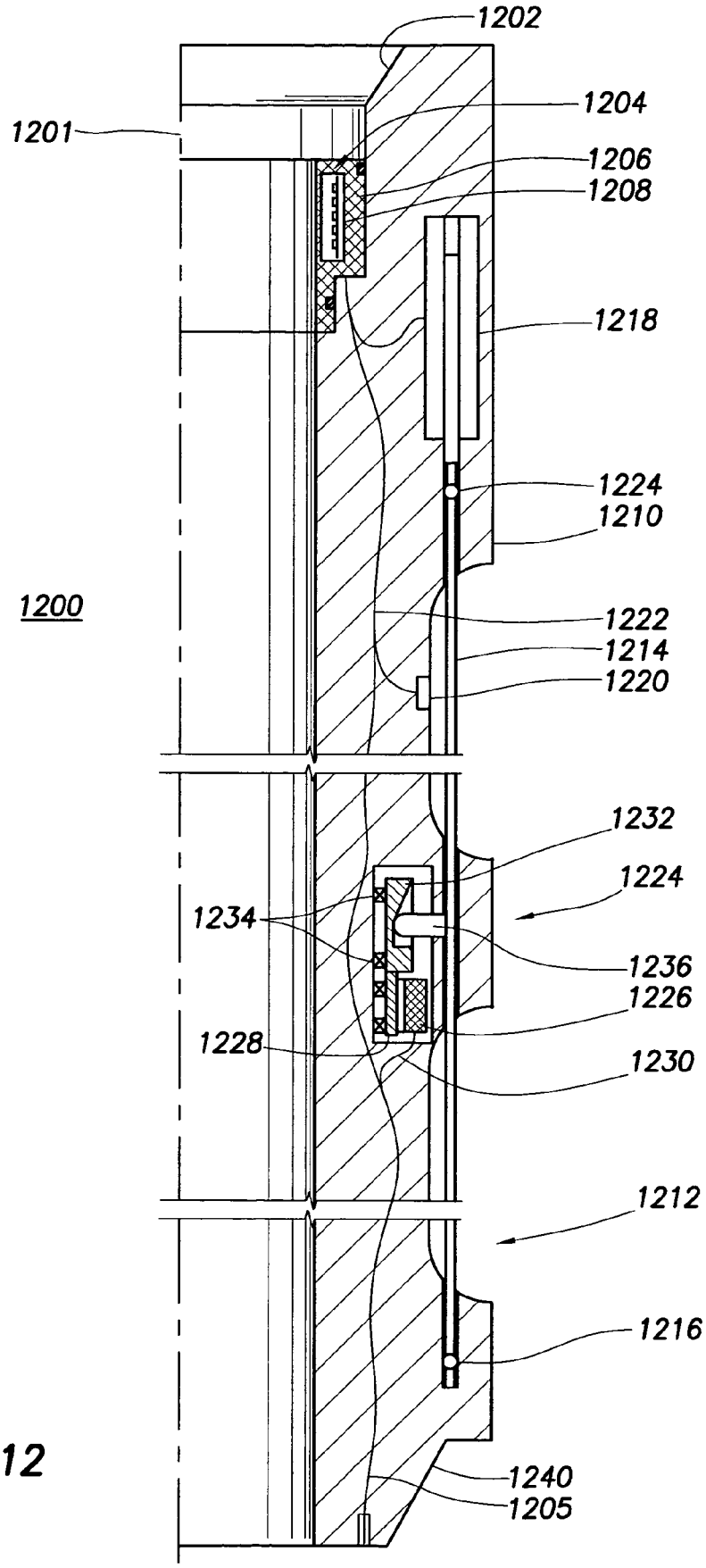
FIG. 12 illustrates a dynamic bending sub.

Another type of energy modulator, shown in FIG. 12 in cross-section with center line 1201, is a dynamic bending sub which provides the ability to dynamically bend a limber collar. The dynamic bending sub 1200 includes a box connector 1202 and a pin connector 1240 for making up to pipe string. A power and communications connector 1204 may be included to allow connection of power and communication signals from the pin connector above in the drill string. In this embodiment, and generally for all the energy modulator embodiments disclosed herein, the power and communications signals received through the power and communications connector (here 1204) may be routed through the dynamic bending sub and to a connector at the pin end (here 1207) to provide the signals to the next lower drill pipe in the drill string. The dynamic bending sub 1200 may include an electronics insert 1206, which may include a printed circuit board ("PCB") 1208. The PCB may be controllable through the communications media 170 by the surface real-time processor. The PCB may include one or more sensors useful in the monitoring or control of dynamic bending, including preferably an orthogonal pair of radial acceleration sensors.

The dynamic bending sub 1200 may be configured as a length of drill collar (for identification purposes herein identified as "drill pipe" 1210 into which cutouts 1212 around the diameter of the drill pipe 1210 have been cut. The cutouts 1212 make the dynamic bending sub 1200 more flexible or limber. Tension cables or rods 1214 may extend from near the box connector 1202 to near the pin connector 1240 at a predetermined number, preferably 4, locations around the diameter of the drill pipe 1210. In one embodiment, the locations are equally spaced around the diameter of the drill pipe 1210. In other embodiments the spacing is not equal.

Each tension cable or rod 1214 is preferably secured at one end with cross bolts 1216 within the body of the drill pipe 1210 and, in one embodiment, to a linear actuator 1218, which is housed within the body of the drill pipe 1210. In one embodiment (shown), the tension cables or rods 1214 run in the open above the cut-out 1212 diameter. In another embodiment (not shown), the tension cable or rods run in grooves cut axially along and just below the cut-out 1212 diameter.

The dynamic bending sub 1200 may also include one or more, preferably 4, sensors 1220 spaced around the diameter of the drill pipe 1210. The sensors 1220 detect bending moments in the drill pipe 1210, and may include, for example strain gauges.

Power and communications cables 1222 extend from the PCB 1208 to the sensors 1220 and to the linear actuators 1218 and provide a capability for the PCB, and in some embodiments the surface real-time processor 175 through the communications media, to receive signals from the sensors 1220 and commands to the linear actuators 1218.

For example, it may be desirable to bend the dynamic bending sub 1200 along a plane that cuts through the drill pipe 1210 in a bending direction approximately half way between two of of four equally spaced tension cables or rods 1214. In that case, the PCB would command the two linear actuators attached to the tension cables or rods 1214 on the bending direction side of the drill pipe 1210 to contract, generating additional tension in the tension cables or rods 1214 on that side of the drill pipe 1210. The PCB would also command the two other linear actuators attached to the other tension cables or rods 1214 to extend, reducing the tension in the tension cables or rods 1214 on that side of the drill pipe 1210. As a result, the dynamic bending sub 1200 would bend in the bending direction.

An alternative embodiment, also illustrated in FIG. 12, replaces the linear actuator 1218 with a cross-bolt 1224. Thus, in this embodiment both ends of the tension cables or rods 1214 are secured within the drill pipe 1210. The variation in tension in the tension cables or rods 1214 is provided by a number of rotary actuators with eccentric cams 1224. The rotary actuators with eccentric cams 1224 include a fixed stator 1226 and a rotating rotor 1228. The degree and rate of rotation of the rotor 1228 with respect to the stator 1226 may be controlled by the PCB through power and communications cables 1230. The rotor 1228 engages a barrel cam 1232, with an eccentric surface, mounted on bearings 1234 so the barrel cam 1232 turns as the rotor 1228 turns. A lateral push pin 1236 may be pressed against the eccentric surface of the barrel cam 1232 by a spring (not shown). The lateral push pin 1236 extends through the outside diameter of the drill pipe 1210, with the penetration sealed by o-rings (not shown), and engages the tension cable or rod 1214. Consequently, as the rotor 1228 turns, under control of the PCB 1208, the cam 1232 turns causing the lateral push pin 1236 to ride along the eccentric surface of the cam 1232 and to move in and out against the tension cable or rod 1214. By turning the rotor to a particular orientation, a particular amount of strain can be induced in the tension cable or rod 1214. Further, by turning the rotor 1228 continuously the amount of strain induced in the tension cable or rod 1214 can be varied periodically.

In general, when tension is increased in a tension cable or rod 1214 on one side of the drill pipe 1210 tension may be decreased by a similar amount in the tension cable or rod 1214 on the opposite side of the drill pipe 1210.

The axial motion modulator 505, the torque modulator 605 and the flex modulator also provide the ability to deliberately create axial, torsional and flex perturbations in the drill string, and by doing so repeatedly, to establish controlled standing waves in the string. The first objective of such controlled perturbations or standing waves might be to precisely cancel perturbations or standing waves evolving from the drilling process which otherwise might be detrimental. Such detrimental standing waves may evolve from the bit/formation interaction as discussed above, from whirl, from the periodic impact of uncentralized pipe in an over-gage hole, from mud motor nutation, and other sources.

In the case of standing waves, at least two sensors, and preferably more must be distributed along the drillstring. The outputs of these sensors are monitored as a function of time and upgoing and downgoing waves may preferably be separated out. Any stationary part (i.e., not upgoing and not downgoing) corresponds to standing wave along the drillstring axis. With appropriate sensors, these techniques can be applied to any kind of wave (e.g., torsional).

Additional applications for such techniques include maintaining the string in a more dynamic state relative to the borehole wall, which may reduce frictional drag and/or improve borehole quality. In some circumstances, deliberately modulating the bit speed and/or weight on bit may increase rate of penetration.

With real time monitoring by proximate sensors, resonant conditions may also be deliberately approached, enabling energy to accumulate in the dynamic system over multiple cycles for a controlled use which might require more energy than otherwise available.

The axial motion modulator 505, the torque modulator 605, and the vibration modulator can also be used to provide vibration isolation to critical downhole elements, such as, for example, a particle accelerator tube. In this case, a system of sensors situated on both sides of the element to be protected would be used to sense the drillstring dynamics and, via a downhole microprocessor and controller, modulate the motion of the package to be protected so as to effectively isolate it from the undesired drillstring motions.

The axial motion modulator 505, the torque modulator 605, the vibration sub and other controllable elements such as the rotary table and the top drive, can be characterized as "major controllable elements," because they add, dampen or modulate kinetic energy in the drilling equipment. A different type of control can be provided by actions of "distributed control elements" positioned at distributed locations along the drill string which add, dampen or modulate other forms of energy, such as thermal, electromagnetic, light, acoustic, and other forms of energy.

Such actions fall generally in the category of changing the boundary conditions of the drill string. It is conventional to take actions with respect to the entire drill string to affect boundary conditions of a part of the drill string or all of the drill string. The apparatus and method illustrated in FIGS. 2 and 3 allow the system to affect local boundary conditions by taking an action or actions with respect to one segment of the drill string, where a segment is an arbitrary portion of the drill string, without taking actions with respect to other segments of the drill string.

Figure 13:
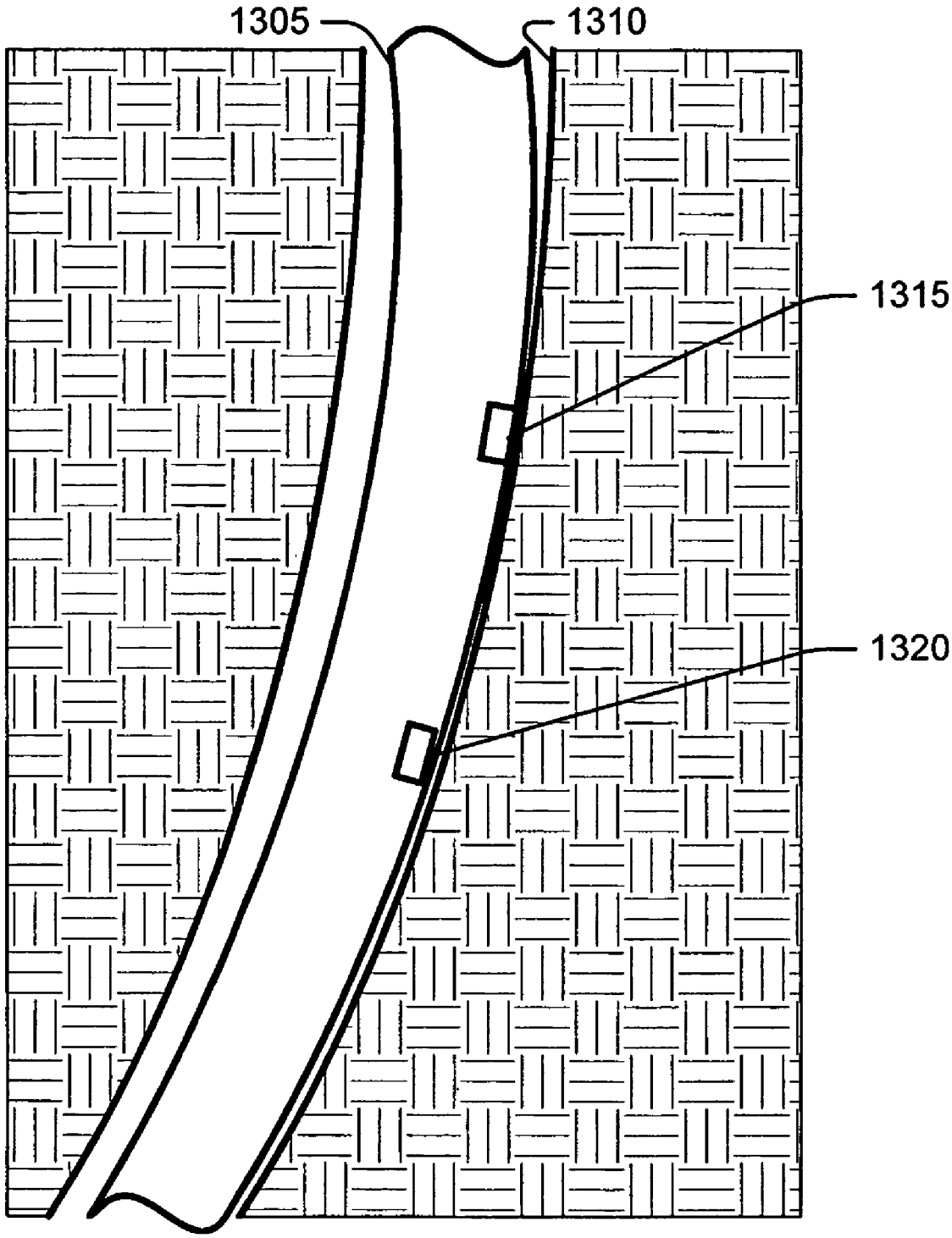
FIG. 13 illustrates a localized boundary condition in a drill string.
Figure 14:
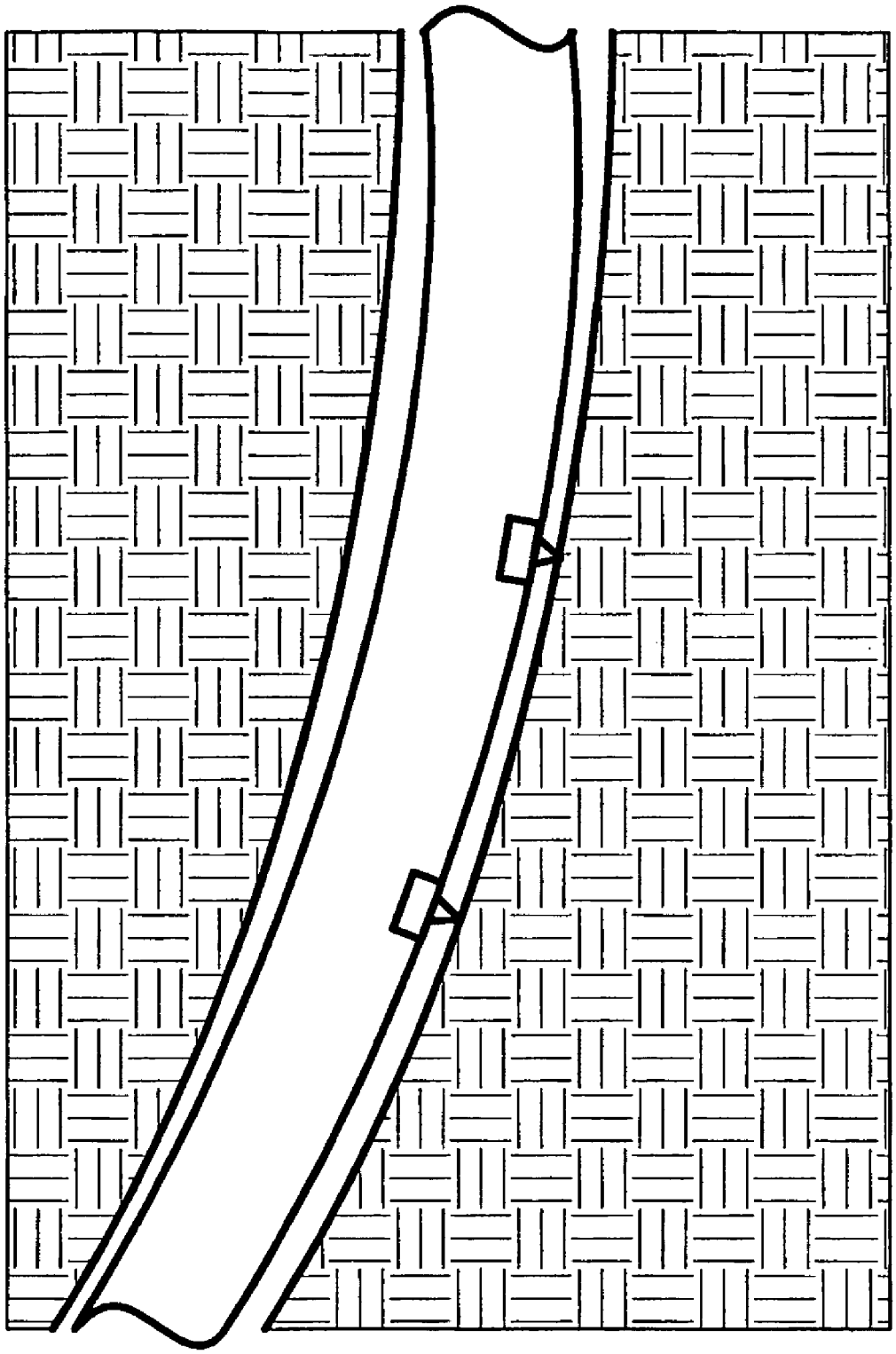
FIG. 14 illustrates apparatus for affecting a localized boundary condition in a drill string.

For example, radial actuators (e.g., integral with upsets every few pipe connections) may extend stabilizer blades, feet, or rollers to reduce the surface area in contact with the formation, and/or stabilize the string, and/or reduce friction. An example, shown in FIG. 13, shows a drill string 1305 pressed against the side of a borehole 1310 producing friction between the drill string and the borehole along that segment of the drill string. Controllable elements 1315 and 1320 are coupled to the drill string. When controllable elements 1315 and 1320 are activated, as shown in FIG. 14, they extend stabilizer blades, feet, or rollers. As a result, friction between the drill string and the borehole wall is reduced. Thus, actuating controllable elements 1315 and 1320 in that segment of the drill string changes a boundary condition (friction) of the drilling equipment in that segment, without the need for actuating controllable elements in other segments of the drill string.

In addition to the controllable elements illustrated in FIGS. 13 and 14, similar devices may be employed to increase surface area in contact with the formation, drag, etc., for braking, damping whirl or bounce, controlling weight transfer to limit helical buckling, etc.

Further, circumferencial overlays or pads, essentially flush with the pipe outside diameter or upset, which in response to control signals emit energy in a distributed manner (i.e. at the particular locations of interest) into the local pipe, the drilling mud flowing in the annulus, the mud cake, or into formation boundaries. For example, acoustic energy, steady or variable, may be emitted to excite local particles and reduce drag, free sticking pipe, etc. Heat energy may be emitted for the same purposes, for example, deliberately causing local phase changes (e.g. gas bubbles) in the drilling mud or in the formation for these purposes. Given the significant hydrostatic pressure, and the limited and localized heat energy that would be applied, the bubbles would quickly collapse and therefore would not represent a kick. This technique however would preferably be used with care, especially when drilling at or below balance, so as to not invite formation fluid influx which could then evolve to a kick situation. Even more heat energy might be applied to seal the formation in particularly difficult zones, which has the effect of improving borehole quality.

Further energy may be emitted from the drill string to affect a property of a component of one of the annulus drilling fluid, the mud cake, the borehole wall, and the near-borehole invaded zone. Further, the energy emission may cause the initiation, acceleration, deceleration, and arresting, of a reaction involving said component. For example, the energy emission may cause a chemical reaction. Alternatively, the emission may cause a physical reaction, such as a change in physical structure, e.g. more or less agglomeration, crystallization, suspension, cementation, etc. The energy emission may, for example, accelerate the reaction of an epoxy component circulated with the drilling fluid.

The energy emission may cause the extension of mechanical feet, rollers, or stabilizer blades in order to change a boundary condition of the drill string. For example, the drill string may be in contact with the borehole so that its transmissions of axial, torsional, or bending waves are damped and it is limited in its degrees of freedom. An extension of mechanical feet, rollers, or stabilizer blades has the capability of improving those circumstances.

Figure 15A:
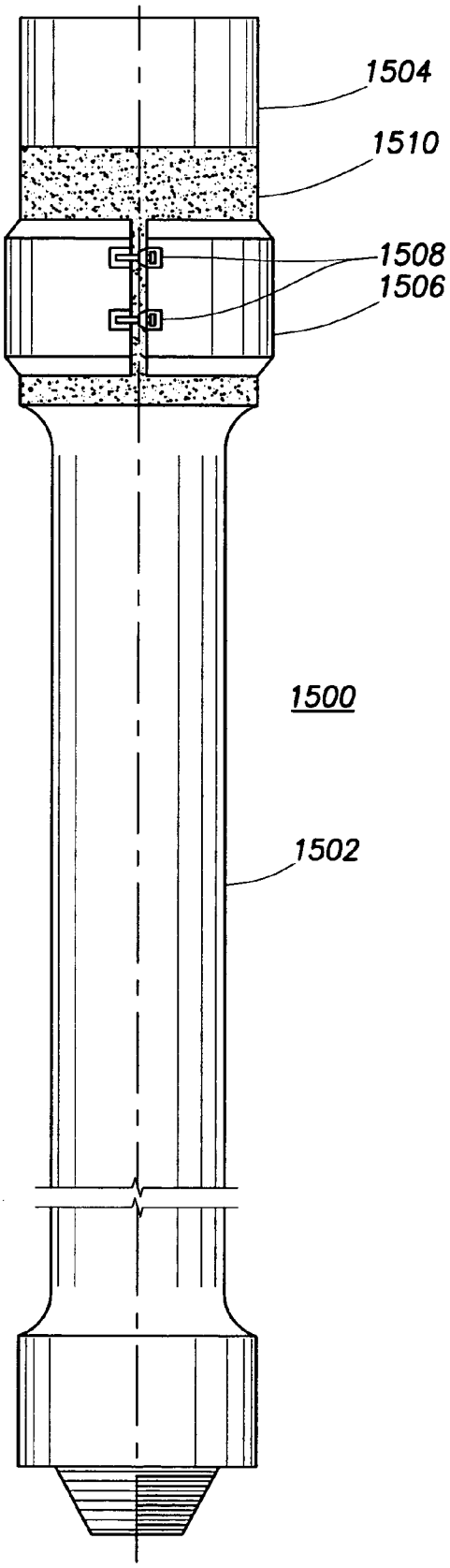
FIGS. 15A and 15B illustrate a heat energy modulator.
Figure 15B:
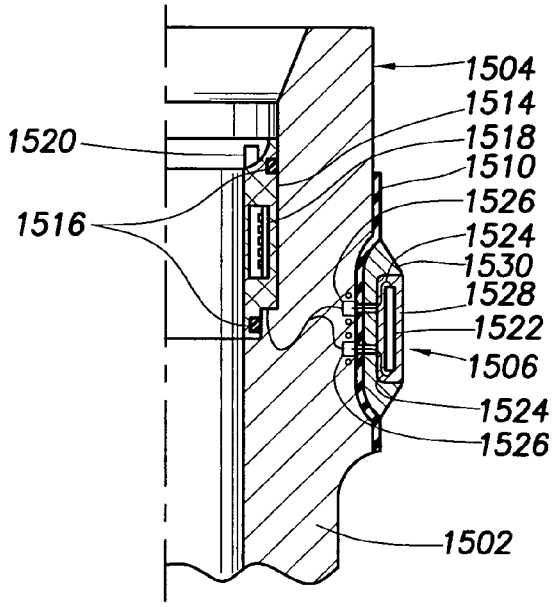

An example heat energy modulator 1500, shown in FIGS. 15A and 15B, includes a joint of drill pipe or a sub 1502 with an elongated box end 1504. A clam-shell heater jacket 1506 is fastened by fasteners 1508 to the outside diameter of the elongated box end 1504. An optional insulating coating 1510 separates the heater jacket 1506 from the elongated box end 1504.

Further, circumferencial overlays or pads, essentially flush with the pipe outside diameter or upset, respond to control signals by emitting energy in a distributed manner (i.e. at the particular locations of interest) into the local pipe, the drilling mud flowing in the annulus, the mud cake, or into formation boundaries. For example, acoustic energy, steady or variable, may be emitted to excite local particles and reduce drag, free sticking pipe, etc. Heat energy may be emitted for the same purposes, for example, deliberately causing local phase changes (e.g. gas bubbles) in the drilling mud or in the formation for these purposes. Given the significant hydrostatic pressure, and the limited and localized heat energy that would be applied, the bubbles would quickly collapse and therefore would not represent a kick. This technique however would preferably be used with care, especially when drilling at or below balance, so as to not invite formation fluid influx which could then evolve to a kick situation. Even more heat energy might be applied to seal the formation in particularly difficult zones, which has the effect of improving borehole quality.

The heater jacket 1506 may include a burner element 1522, which may be a resistive element that heats up when electric current passes through it. The burner element 1522 is activated by the PCB 1518 via control cables 1524 through connectors 1526.

The burner element 1522 may be encased in a thermally conductive hard material 1528 which can withstand the downhole environment and can conduct heat from the heater element 1522. The thermally conductive hard material 1528 may be embedded in a thermally insulative substrate, which is a relatively insulative ceramic "dish" 1530 containing a high temperature, highly insulative fiber and epoxy system molded into place to fill all voids in the portion of the heater jacket 1506 where it resides. The optional insulating coating 1510 underlies the insulative dish 1530.

As can be seen, the amount of heat generated by the heat energy modulator 1500 is under the control of its electronics package, which can be controlled by the surface real-time processor 175 in the arrangement shown in FIG. 2 or as part of a network in the arrangement shown in FIG. 3. One or more sensors which preferably include temperature sensors (not shown) may be included within the PCB, and temperature sensors preferably also may be integrated with the burner element 1522, the thermally conductive hard material 1528, and/or on the pipe exterior somewhat removed from the heat source. Several of such sensors may preferably be used to monitor the temperature and local temperature rise associated with the heat energy modulator, and for purposes of control.

Figure 16:
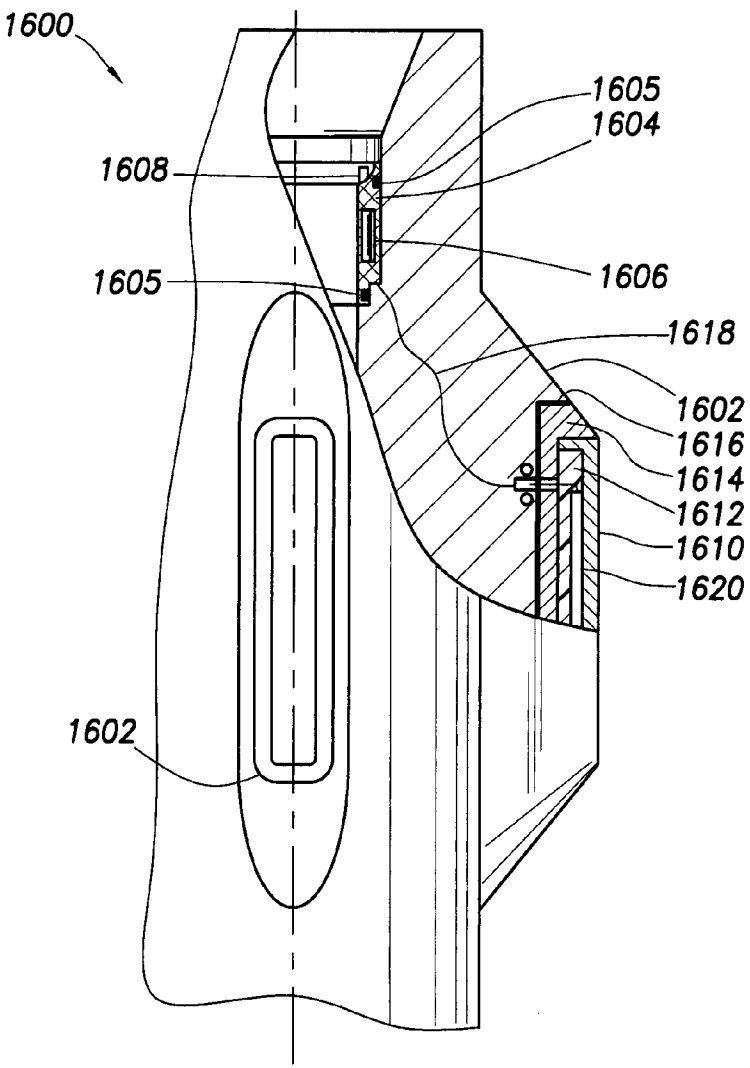
FIG. 16 illustrates a heat energy modulator

Another embodiment of a heat energy modulator, illustrated in FIG. 16, is incorporated in a stabilizer sub 1600. The stabilizer sub 1600 includes blades 1602 spaced around its outside diameter. In FIG. 16, one of the stabilizer blades 1602 is shown in a perspective view and the other is shown in cross-section. The stabilizer sub 1600 may include an electronics package 1604, sealed by o-rings 1605, which includes a PCB 1606. The electronics package 1604 and the PCB 1606 communicate with other elements of the drill string, and in some cases the surface real-time processor 175 via the communications media 170, through connector 1608. Typically, while the stabilizer sub 1600 may include more than one electronics package 1604, it only includes a single connector 1608, although more than one connector is within the scope of the invention. One or all of the blades 1602 include heating elements 1620 which are protected as described above with respect to FIG. 15, by a thermally conductive hard material 1610 and encased by a fiber and epoxy system 1612 molded into place on a insulative ceramic base 1614, which is optionally separated from the stabilizer blade by a insulative coating 1616. The thermally conductive hard metal may be covered by an optional CVD diamond overlay. The heating element 1620 is connected to the PCB by cables 1618. In this way, the PCB, can control the current flowing through, and thus the heat produced by, the heating element 1604. One or more sensors, preferably temperature sensors (not shown) may be incorporated into this structure in a similar manner as discussed in the previous heat energy modulator embodiment, for similar purposes.

As can be seen, the amount of heat generated by the heat energy modulator shown in FIG. 16 is under the control of its electronics package, which can be controlled by the surface real-time processor 175 in the arrangement shown in FIG. 2 or as part of a network in the arrangement shown in FIG. 3.

Figure 17:
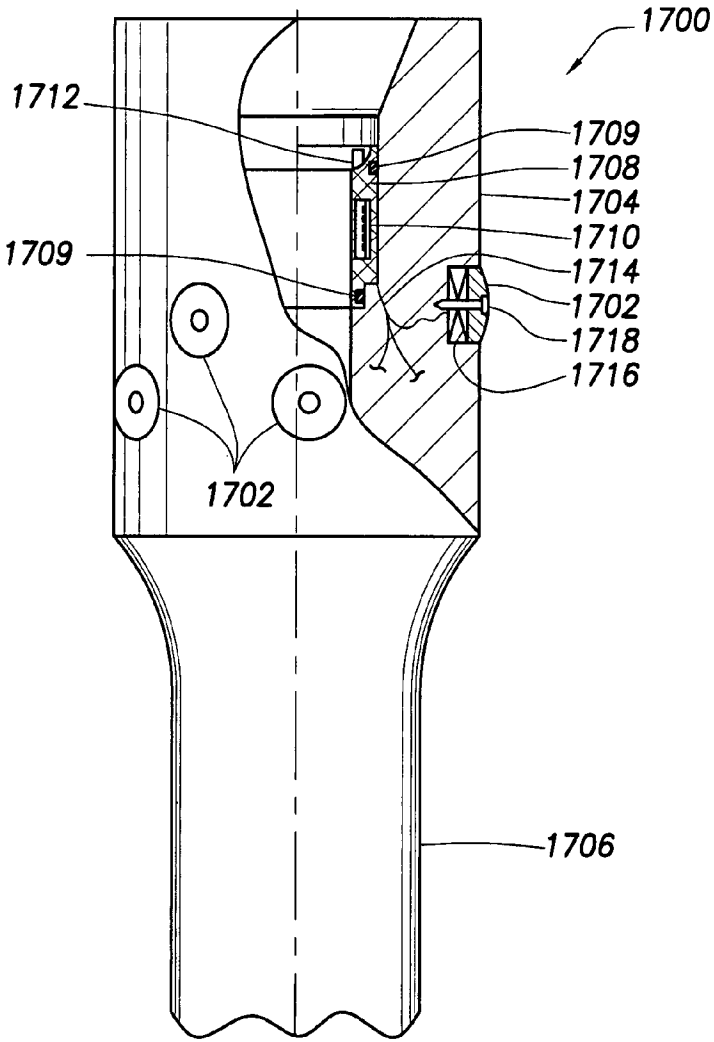
FIG. 17 illustrates a sonic energy modulator.

An embodiment of an sonic energy modulator 1700 that generates sonic energy to affect a change in a local boundary condition, illustrated in FIG. 17, includes sonic excitation buttons 1702 mounted in the box end 1704 of a joint of drill pipe 1706. In FIG. 17, three of the sonic excitation buttons 1702 are shown in perspective view and a fourth is shown in cross-section. The sonic energy modulator 1700 includes an electronics package 1708, sealed by o-rings 1709, which includes a PCB 1710. The electronics package 1708 and the PCB 1710 communicate with other elements of the drill string, and in some cases the surface real-time processor 175 via the communications media 170, through connector 1712. A set of power and communications cables 1714 connect the electronics package 1708 with the sonic excitation buttons 1702, providing them with power and excitation signals. Each sonic excitation button excitation button includes a Belleville spring support 1716 inserted into a cavity in the box end 1704 of the joint of drill pipe 1706. A piezo electric crystal is inserted into the cavity over the spring support 1716 and is connected to the power and communications cables 1714. A bolt with a spring washer under its head 1718 secures the sonic excitation button 1702 in position.

As can be seen, the amount of sonic energy generated by the sonic energy modulator 1700 is under the control of its electronics package, which can be controlled by the surface real-time processor 175 in the arrangement shown in FIG. 2 or as part of a network in the arrangement shown in FIG. 3. Sensors (not shown) may be integrated with the buttons 1702, or provided independently of but proximate to the buttons, which may be useful in monitoring and control of the sonic energy modulator.

An electrical potential, field, or field reversals might be applied to alleviate sticking and balling and other similar issues along the string associated with polar mud particle.

Heat energy, electrical potential, and/or particular frequency light energy, might be applied to activate particular mud additives, whether entrained in the mud or already built up in the borehole mud cake, to change the mud or mud cake properties, e.g. reduce friction, increase yield strength and carrying capacity, and/or to change viscosity.

Figure 18:
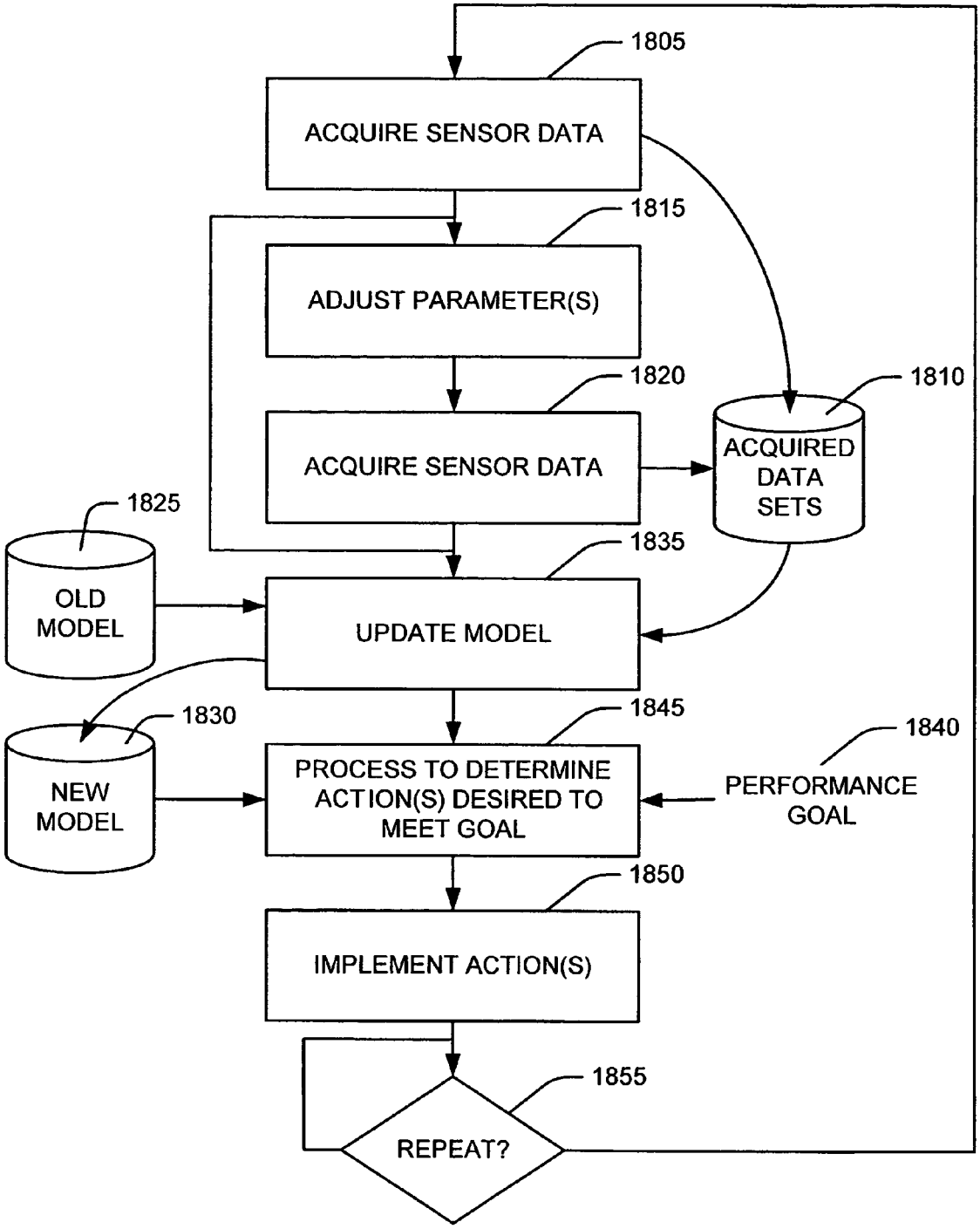
FIG. 18 illustrates a flow chart for a system that provides local responses to local conditions in an oil well.

The operation of the system, illustrated in FIG. 18, is generally similar whether the system is configured as shown in FIG. 2 or as shown in FIG. 3. If the system is configured as shown in FIG. 2, the operation of the system may be directed by the surface real-time processor. If the system is configured as shown in FIG. 3, the operation of the system may be directed by the autonomous network of controllers 315, perhaps with some assistance from the surface real-time processor 175. In one embodiment, data is acquired from one or more sensor modules 210, 310 (which may be packaged integrally with, or independent of, particular actuator modules) at the prevailing controlled drilling parameter set (i.e. WOB and rotary speed, and/or the controlled periodic or non-periodic actuation of one or more of the energy modulators 205, 305) (block 1805) and stored in a data store of acquired data sets 1810.

Optionally, but preferably, one (or more, preferably one at a time) of the prevailed controlled drilling parameter set is modified (block 1815) and a second data set is acquired from one or more of the sensors reflective of the adjusted parameter set (block 1820). That is, the drilling equipment operating parameters are modified by, for example, changing the WOB, modifying the rotary speed or varying any energy that is being added to or removed from the system by an energy modulators. The second data set may be stored in the acquired data sets data store 1810.

Data from the two data sets stored in the acquired data sets data store 1810, if available, may be processed, optionally in context of an old model of the drill string and drilling process 1825, to create a new model of the drill string and drilling process 1830 (block 1835). Both the old model and the new model may include a transfer function description of the drill string and drilling process.

The system may take a desired goal 1840 (e.g. reduced non-constructive drill string behavior, or initiation of a particular drill string behavior believed beneficial to the drilling process) provided by and operator or from another process, and iteratively or analytically determines which energy modulators to activate and the parameters associated with that activation (block 1845). The system then initiates or adjusts actuation of one or more of the energy modulators accordingly (block 1850). The system then optionally repeat this sequence periodically, and/or when a behavior appears to change outside of thresholds, etc (block 1855).

The present invention is therefore well-adapted to carry out the objects and attain the ends mentioned, as well as those that are inherent therein. While the invention has been depicted, described and is defined by references to examples of the invention, such a reference does not imply a limitation on the invention, and no such limitation is to be inferred. The invention is capable of considerable modification, alteration and equivalents in form and function, as will occur to those ordinarily skilled in the art having the benefit of this disclosure. The depicted and described examples are not exhaustive of the invention. Consequently, the invention is intended to be limited only by the spirit and scope of the appended claims, giving full cognizance to equivalents in all respects.

What is claimed is:

1. A system for controlling oil well drilling dynamics, including:

a plurality of downhole sensor modules, which, when distributed along and coupled to a first portion of a drill string are capable of detecting a lumped parameter of a second portion of the drill string, each downhole sensor module producing a sensor signal; and one or more controllable element modules, which, when distributed along and coupled to a third portion of the drill string is or are capable of affecting the lumped parameter of the second portion of the drill string, each controllable element module being responsive to a controllable element signal.

2. The system of claim 1 further comprising:

a communications media, which can be coupled to the downhole sensor modules and the downhole controllable element modules.

3. The system of claim 1 further comprising:

a processor, coupled to the controllable element modules and the sensor modules, the processor being capable of:

receiving sensor signals from the plurality of downhole sensor modules; and transmitting controllable element signals to the one or more controllable element modules.

4. The system of claim 3 further comprising:

a program stored on a computer-readable media, the program being capable of execution on the processor, the program being capable of:

processing in real time the received sensor signals to determine the lumped parameter of the second portion of the drill string; and generating in real time the controllable element signals to transmit to affect the lumped parameter of second portion of the drill string.

5. The system of claim 1 where a lumped parameter includes:

a parameter associated with a series mass-spring-damper model of the drill string.

6. The system of claim 1 where a lumped parameter includes:

a parameter associated with a non-infinitesimal region of the drill string.

7. The system of claim 1 where the one or more controllable element modules include:

a plurality of downhole controllable element modules, which when distributed along a drill string are capable of effecting the condition of the drill string as a whole.

8. The system of claim 1 where the first portion is encompassed by the second portion.

9. The system of claim 1 where the second portion is encompassed by the first portion.

10. The system of claim 1 where the third portion is encompassed by the second portion.

11. The system of claim 1 where the first portion is substantially the same as the second portion and substantially the same as the third portion.

12. A system for providing a local response to a local condition in an oil well, including a sensor to detect a local condition in a drill string;

a controllable element to modulate energy in the drill string; and a controller coupled to the sensor and to the controllable element, the controller to:

receive a signal from the sensor, the signal indicating the presence of said local condition;

process the signal to determine a local energy modulation in the drill string to modify said local condition; and send a signal to the controllable element to cause the determined local energy modulation.

13. The system of claim 12 further comprising:

an electrical power source to provide power for the controllable element.

14. The system of claim 13 where the oil well extends from the surface and where:

the electrical power source is on the surface.

15. The system of claim 12 further comprising:

one or more other sensors to detect the undesirable local condition in the drill string; and where processing the signal includes performing a joint inversion of data from the sensor and the other sensors.

16. The system of claim 12 where the controllable element modulates energy in the drill string by adding energy to the drill string.

17. The system of claim 12 where the controllable element modulates energy in the drill string by dampening energy in the drill string.

18. The system of claim 12 where the controllable element modulates energy in the drill string by modifying energy to the drill string.

19. The system of claim 12 where the controllable element modulation is periodic.

20. The system of claim 12 where the oil well includes a rotating drill string and where the controllable element modulation occurs once per portion of a revolution of the drill string.

21. The system of claim 12 where the undesirable location condition has characteristics and where:

the controllable element modulates energy in the drill string having the same characteristics as the condition.

22. The system of claim 12 where the controllable element modulates energy substantially in an axial direction.

23. The system of claim 12 where the controllable element modulates energy substantially in a torsional direction.

24. The system of claim 12 where the controllable element modulates energy substantially in at least one of lateral and radial directions.

25. The system of claim 12 where the controllable element includes a dynamic bumper sub including:

a housing;

a mandrel slideably mounted to the housing so as to allow relative movement in the axial direction;

a spring to carry an axial load between the solenoid and the mandrel; and an electrically powered actuator mounted to a structure selected from the housing and the mandrel, wherein the actuator is responsive to command signals.

26. The system of claim 25 further including:

a fluid chamber defined between the mandrel and the housing, wherein the chamber comprises a control orifice which restricts fluid flow between two sections of the chamber, wherein the control orifice varies its cross-sectional area in response to command signals.

27. The system of claim 25 where the actuator includes a solenoid.

28. The system of claim 25 where the actuator response to a command signal includes relative movement in an axial direction.

29. The system of claim 12 where the controllable element includes a dynamic bumper sub including:

a housing;

a mandrel slideably mounted to the housing so as to allow relative movement in the axial direction;

a telescoping chamber defined between the housing;

a generator of high pressure fluid in fluid communication with the telescoping chamber, wherein the generator pumps fluid into the telescoping chamber in response to command signals causing the telescoping chamber to telescope; and a return element to urge the telescoping chamber against telescoping.

30. The system of claim 29 where the return element includes:

a spring.

31. The system of claim 29 where the return element includes:

a retracting chamber, wherein the generator pumps fluid into the retracting chamber in response to command signals.

32. The system of claim 31 where the generator either pumps fluid into the retracting chamber or the telescoping chamber, but not both.

33. The system of claim 12 where the controllable element includes a dynamic clutch sub including:

a housing;

a mandrel coaxially mounted to the housing so as to allow relative rotational movement; and an actuator to modulate at least one of the relative rotation and the torque between the housing and mandrel, said modulation in response to command signals.

34. The system of claim 33 where:

the actuator is mounted to a structure selected from the housing and the mandrel;

the actuator moves a clutch plate in response to the command signal; and a friction plate is mounted to a structure selected from the housing and the mandrel other than the structure to which the actuator is mounted, wherein the friction plate is positioned proximate the clutch plate, wherein the clutch plate is engageable with the friction plate when the actuator is actuated.

35. The system of claim 12 where the controllable element includes a vibrator sub including:

a housing;

a mandrel slidably mounted to the housing so as to allow relative movement in the axial direction; and an actuator to create a vibration between the housing and mandrel in response to a command signal.

36. The system of claim 35 where the actuator includes:

a piezo electric crystal mounted to a structure selected from the housing and the mandrel, wherein the piezo electric crystal is expandable in response to a command signal.

37. The system of claim 12 where the controllable element includes a bending sub including:

a longitudinal housing having a first end and a second end;

one or more circumferencial cutouts in the housing; and one or more tensors, each tensor secured at one end of the housing, crossing the one or more circumferencial cutouts, and coupled at the other end to a controllable actuator.

38. The system of claim 12 where:

the controllable actuator is a linear actuator.

39. The system of claim 12 where the controllable element includes a bending sub including:

a longitudinal housing having a first end and a second end;

one or more circumferencial cutouts in the housing;

one or more tensors, each tensor secured at each end of the housing and crossing the one or mor circumferencial cutouts; and one or more controllable actuator to press radially against the tensors.

40. The system of claim 39 where at least one tensor includes a cable.

41. The system of claim 39 where at least one tensor includes a rod.

42. The system of claim 39 where the controllable actuator includes:

a motor;

a barrel cam with an eccentric surface coupled to the motor; and a push pin extending outside the longitudinal housing to ride on the eccentric surface of the baffel cam.

43. The system of claim 12 where the controllable element includes a heating sub including:

a housing; and one or more controllable heating elements secured in the housing to provide heat outside the housing.

44. The system of claim 12 where the controllable element includes a sonic sub including:

a housing; and one or more controllable sonic generators secured in the housing to provide sonic energy outside the housing.

45. The system of claim 12 further including:

a communications medium coupled to:

the sensor;

the controllable element; and the controller.

46. The system of claim 45 where the communications medium includes:

a wired drill pipe.

47. A method for providing a local response to a local condition in an oil well, including detecting a local condition in a drill string;

determining a local energy modulation in the drill string to modify said local condition; and causing the determined local energy modulation in the drill string.

48. The method of claim 47 further including:

providing electrical power to cause the determined local energy modulation in the drill string.

49. The method of claim 48 where the oil well extends from the surface and where providing electrical power includes:

providing electrical power from the surface.

50. The method of claim 47 further comprising:

detect the undesirable local condition from more than one location in the drill string; and where processing the signal includes performing a joint inversion of the detected undesirable local condition from the more than one location in the drill string.

51. The method of claim 47 where causing the determined local energy modulation in the drill string includes:

adding energy to the drill string.

52. The method of claim 47 where causing the determined local energy modulation in the drill string includes:

dampening energy in the drill string.

53. The method of claim 47 where causing the determined local energy modulation in the drill string includes:

modifying energy in the drill string.

54. The method of claim 47 where causing the determined local energy modulation in the drill string includes causing a periodic energy modulation in the drill string.

55. The method of claim 47 where the oil well includes a rotating drill string and where causing the determined local energy modulation in the drill string includes causing an energy modulation in the drill string once per portion of a revolution of the drill string.

56. The method of claim 47 where the undesirable location condition has characteristics and where:

causing the determined local energy modulation in the drill string includes causing a local energy modulation in the drill string having the same characteristics as the condition.

57. The method of claim 47 where causing the determined local energy modulation in the drill string includes:

adding energy to the drill string.

58. The method of claim 57 where adding energy to the drill string includes adding kinetic energy to the drill string.

59. The method of claim 57 where adding energy to the drill string includes adding one or more of the following types of energy to the drill string: axial energy, radial energy, lateral energy, and torque.

60. The method of claim 47 where causing the determined local energy modulation in the drill string includes:

dampening energy in the drill string.

61. The method of claim 47 where causing the determined local energy modulation in the drill string includes:

modifying energy in the drill string.

62. A system for use in drilling an oil well using drilling equipment including a drill string having segments, the oil well having an annulus through which drilling fluid flows, a borehole, including a wall and mud cake, and a near-borehole invaded zone, the system including:

an energy emission device able to be mounted within the drill string;

said device electrically powered, and controlled by a processor;

said energy emission device to emit energy to at least one of the annulus drilling fluid, the borehole mud cake, the borehole wall, and the near-borehole invaded zone;

said energy emission having a characteristic intended to affect a local boundary condition.

63. The system of claim 62 further including:

a downhole sensor able to be mounted within the drill string for detecting a parameter indicative of the local boundary condition associated with a segment of the drill string.

64. The system of claim 62 where the energy emission device is able to emit energy of one or more of the following types: acoustic, electromagnetic, light, thermal, and kinetic.

65. The system of claim 62 where the energy emission device is able to emit energy that affects the drag of the drill string in the borehole.

66. The system of claim 62 where the energy emission device is able to emit energy that affects the quality of the borehole.

67. A system for use in drilling an oil well using drilling equipment including a wired drill string, having segments, the oil well having an annulus through which drilling fluid flows, a borehole, including a wall and mud cake, and a near-borehole invaded zone, the system including:

a downhole sensor able to be mounted within the wired drill string for detecting a parameter indicative of a local boundary condition associated with a segment of the wired drill string;

an energy emission device able to be mounted within the wired drill string;

said device electrically powered, and controlled by a processor through the wired drill string;

said energy emission device to emit energy to at least one of the annulus drilling fluid, the borehole mud cake, the borehole wall, and the near-borehole invaded zone;

said energy emission having a characteristic intended to affect the local boundary condition.

68. The system of claim 67 where the energy emission device is able to emit energy of one or more of the following types: acoustic, electromagnetic, light, thermal, and kinetic.

69. The system of claim 67 where the energy emission device is able to emit energy that affects the drag of the drill string in the borehole.

70. The system of claim 67 where the energy emission device is able to emit energy that affects the quality of the borehole.

71. A method for drilling an oil well using drilling equipment including a drill string having segments, the oil well having an annulus through which drilling fluid flows, a borehole, including a wall and mud cake, and a near-borehole invaded zone, the method including:

detecting a parameter indicative of a local boundary condition associated with a segment of the drill string; and emitting energy having a characteristic intended to affect the local boundary condition to at least one of the annulus drilling fluid, the borehole mud cake, the borehole wall, and the near-borehole invaded zone.

72. The method of claim 71 where emitting energy includes emitting energy of one or more of the following types: acoustic, electromagnetic, light, thermal, and kinetic.

73. The method of claim 71 where emitting energy includes emitting energy that affects the drag of the drill string in the borehole.

74. The method of claim 71 where emitting energy includes emitting energy that affects the quality of the borehole.

75. The method of claim 71 where emitting energy includes affecting a property of a component of one of the annulus drilling fluid, the mud cake, the borehole wall, and the near-borehole invaded zone.

76. The method of claim 75 further including:

causing at least one of the initiation, acceleration, deceleration, and arresting, of a reaction involving said component.

77. The method of claim 76 where the reaction is a chemical reaction.

78. The method of claim 76 where the reaction is a physical reaction.

79. The method of claim 71 where emitting energy includes emitting energy that accelerates a reaction of at least one epoxy component being circulated with the drilling fluid.

80. A system for use in drilling an oil well using drilling equipment including a drill string having segments, the drill string being in a borehole having a wall, the system including:

a downhole sensor able to be mounted within the drill string for detecting a limitation of the transmission of mechanical energy along the drill string caused by contact between the borehole wall and a segment of the drill string;

an energy emission device able to be mounted within the drill string;

said device electrically powered, and controlled by a processor; and said energy emission device to emit energy to reduce the limitation.

81. The system of claim 80 where the energy emission device includes:

a device to generate separation between the limitation-affected segment of the drill string and the borehole wall.

82. The system of claim 81 where the device includes one or more of the following: mechanical feet, rollers, and stabilizer blades.

83. A method for drilling an oil well using drilling equipment including a drill string having segments, the drill string being in a borehole having a wall, the method including:

detecting a limitation of the transmission of mechanical energy along the drill string caused by contact between the borehole wall and a segment of the drill string;

emitting energy locally from the drill string to reduce the limitation.

84. The method of claim 83 where emitting energy includes:

generating separation between the limitation-affected segment of the drill string and the borehole wall.

85. The method of claim 84 where generating separation includes extending one or more of the following: mechanical feet, rollers, and stabilizer blades.

* * * * *